US009375922B2

(12) United States Patent
Tatsumi et al.

(10) Patent No.: US 9,375,922 B2
(45) Date of Patent: Jun. 28, 2016

(54) METHOD OF MANUFACTURING LIQUID JET HEAD

(71) Applicants: SII PRINTEK INC., Chiba-shi, Chiba (JP); SEIKO INSTRUMENTS INC., Chiba-shi, Chiba (JP)

(72) Inventors: Tokio Tatsumi, Chiba (JP); Satoshi Horiguchi, Chiba (JP)

(73) Assignees: SII PRINTEK INC. (JP); SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/639,233

(22) Filed: Mar. 5, 2015

(65) Prior Publication Data

US 2015/0258792 A1 Sep. 17, 2015

(30) Foreign Application Priority Data

Mar. 12, 2014 (JP) ..... 2014-049363

(51) Int. Cl.
*B41J 2/16* (2006.01)
*B41J 2/14* (2006.01)

(52) U.S. Cl.
CPC ..... *B41J 2/14209* (2013.01); *B41J 2/161* (2013.01); *B41J 2/1609* (2013.01); *B41J 2/1623* (2013.01); *B41J 2/1631* (2013.01); *B41J 2/1632* (2013.01); *B41J 2/1643* (2013.01); *B41J 2/14233* (2013.01); *B41J 2002/14491* (2013.01); *Y10T 29/42* (2015.01); *Y10T 29/49126* (2015.01); *Y10T 29/49165* (2015.01); *Y10T 29/49401* (2015.01)

(58) Field of Classification Search
CPC .. B41J 2/14209; B41J 2/14233; B41J 2/1609; B41J 2/161; B41J 2/1623; B41J 2/1631; B41J 2/1632; B41J 2/1643; B41J 2/14491; Y10T 29/42; Y10T 29/49126; Y10T 29/49401; Y10T 29/49165
See application file for complete search history.

(56) References Cited

U.S. PATENT DOCUMENTS 8,141,250 B2 * 3/2012 Tanaka ..... B41J 2/14233 29/25.35
2006/0017778 A1 1/2006 Okuno ..... 347/50

FOREIGN PATENT DOCUMENTS

JP 2001341298 12/2001
JP 2002210955 7/2002
JP 2009234019 A * 10/2009

OTHER PUBLICATIONS

Intellectual Property Office Search Report mailed Sep. 11, 2015 issued in Appln. No. GB1504210.4.

* cited by examiner

*Primary Examiner* — A. Dexter Tugbang
(74) *Attorney, Agent, or Firm* — Adams & Wilks

(57) ABSTRACT

A method of manufacturing a liquid jet head includes a through hole forming step of forming through holes on a base plate, an actuator plate bonding step of bonding actuator plates to opposite sides of the base plate, and an electrode forming step of forming electrodes on the bonded base plate and the actuator plates. In the through hole forming step, the through holes are formed on the base plate and the inner surfaces of the through holes are roughened. In the electrode forming step, second extraction electrodes are routed to a principal surface of the base plate through the through holes.

4 Claims, 18 Drawing Sheets

METHOD OF MANUFACTURING LIQUID JET HEAD

BACKGROUND

1. Technical Field

The present invention relates to a method of manufacturing a liquid jet head, a liquid jet head, and a liquid jet apparatus.

2. Related Art

Conventionally, as an apparatus which ejects ink in the form of droplets (hereinbelow, just referred to as "ink droplets") toward a recording medium to record characters or images thereon, there has been used an ink jet printer (liquid jet apparatus) provided with an ink jet head (liquid jet head) which ejects ink droplets toward a recording medium from a plurality of nozzle holes.

The above inkjet head is provided with a head chip. For example, a head chip disclosed in JP 2001-341298 A is provided with a base plate which is made of, for example, glass and a plurality of partition walls which are arrayed on the base plate and made of a piezoelectric material, wherein channels for housing ink are defined between the partition walls. Drive electrodes are formed on side surfaces of the partition walls and electrically connected to extraction electrodes formed on the base plate. A flexible printed board is connected to the extraction electrodes on the outer side with respect to the partition walls.

In this configuration, when voltage is applied to the drive electrodes through the flexible printed board and the extraction electrodes, the partition walls are deformed. The deformation of the partition walls increases the pressure inside the channels, and ink housed inside the channels are thereby ejected through nozzle holes.

Recently, there have been proposed various techniques for increasing the number of nozzle holes in order to improve the density of characters or images recorded on a recording medium. For example, JP 2001-341298 A discusses a configuration in which a base plate of a first head chip and a base plate of a second head chip are bonded to each other to achieve high-density recording.

SUMMARY

However, in the configuration disclosed in JP 2001-341298 A, the extraction electrodes are formed on each of the base plates of the respective head chips. Thus, it is necessary to separately connect flexible printed boards to the extraction electrodes of the first head chip and to the extraction electrodes of the second head chip, which increases the number of components and may result in a complicated configuration.

Further, when a conductive ink such as a water-based ink is used in a so-called three-cycle type ink jet head in which ink is housed in each of the channels and sequentially ejected from the channels as in the configuration of JP 2001-341298 A, a short circuit occurs between the drive electrodes through the ink. Therefore, the configuration of JP 2001-341298 A cannot cope with various types of ink, and there is scope for improvement in convenience improvement.

The present invention has been made in view of the above circumstances, and an object thereof is to provide a method of manufacturing a liquid jet head, a liquid jet head, and a liquid jet apparatus capable of achieving high-density recording while reducing the number of components and simplifying the configuration.

The present invention provides the following means in order to solve the above problems.

A method of manufacturing a liquid jet head according to the present invention includes: a through hole forming step of forming through holes on a base plate; an actuator portion disposing step of separately disposing a first actuator portion and a second actuator portion, the first actuator portion and the second actuator portion being configured to jet liquid, on opposite sides in the thickness direction of the base plate at positions avoiding the through holes; and a plating step of performing plating on the base plate, the first actuator portion, and the second actuator portion to form first electrodes configured to drive the first actuator portion and second electrodes configured to drive the second actuator portion, wherein the through hole forming step includes a boring step of forming the through holes on the base plate, and a processing step of roughening inner surfaces of the through holes formed in the boring step, and the second electrodes are routed to a principal surface of the base plate through the through holes, the principal surface facing the first actuator portion, in the plating step.

According to this configuration, the second electrodes are routed to the first actuator portion of the base plate through the through holes. Thus, it is possible to ensure electrical continuity between each of the actuator portions and an external wiring line merely by connecting the external wiring line, for example, a flexible printed board only to the first actuator portion of the base plate. Therefore, it is possible to achieve high-density recording while reducing the number of components and simplifying the configuration compared to a conventional configuration in which separate external wiring lines are connected to the respective surfaces of the base plate.

In particular, according to the configuration of the present invention, roughening the inner surfaces of the through holes in the through hole forming step enables the inner surfaces of the through holes to have an anchor effect. Accordingly, the plating film can be collectively formed on the first electrodes and the second electrodes including the inner surfaces of the through holes. As a result, it is possible to improve the efficiency of the manufacturing process steps and also to simplify the manufacturing process steps.

Further, in the method of manufacturing the liquid jet head according to the present invention, the boring step and the processing step may be collectively performed in the through hole forming step.

This configuration makes it possible to roughen the inner surfaces of the through holes simultaneously with the formation of the through holes. As a result, it is possible to improve the efficiency of the manufacturing process steps.

Further, in the method of manufacturing the liquid jet head according to the present invention, the sandblast may be used in the boring step.

According to this configuration, it is possible to more easily roughen the inner surfaces of the through holes by using sandblast.

Accordingly, it is possible to further improve the efficiency of the manufacturing process steps.

Further, in the method of manufacturing the liquid jet head according to the present invention, the material of the base plate may be a glass material.

According to this configuration, since the base plate is made of the glass material, it is possible to reduce the surface roughness. In this case, for example, it is possible to selectively give an anchor effect only to a part of the base plate that has been roughened in the processing step in the plating step. That is, it is possible to allow the plating film to be deposited only on the roughened part of the base plate, but not on a part other than the roughened part. Accordingly, it is not necessary to perform a patterning step after the formation of the plating film. Thus, it is possible to improve the efficiency of the manufacturing process steps and also to reduce the manufacturing cost.

Further, a liquid jet head according to the present invention is manufactured using the above method of manufacturing the liquid jet head of the present invention.

According to this configuration, the liquid jet head is manufactured using the above method of manufacturing the liquid jet head of the present invention. Therefore, it is possible to provide the liquid jet head that achieves high-density recording while reducing the number of components and simplifying the configuration.

A liquid jet apparatus according to the present invention includes the above liquid jet head of the present invention and a movement mechanism configured to relatively move the liquid jet head and a recording medium.

According to this configuration, the liquid jet apparatus is provided with the above liquid jet head of the present invention. Therefore, it is possible to provide the liquid jet apparatus capable of coping with high-density recording and having excellent reliability.

Effect of Invention

The present invention makes it possible to achieve high-density recording while reducing the number of components and simplifying the configuration.

BRIEF DESCRIPTION OF DRAWINGS

FIGS. 11A and 11B are explanatory diagrams (cross-sectional views) for explaining the method of manufacturing the ink jet head, wherein FIG. 11A illustrates the first head chip and FIG. 11B illustrates the second head chip;

FIGS. 12A and 12B are explanatory diagrams (cross-sectional views) for explaining the method of manufacturing the ink jet head, wherein FIG. 12A illustrates the first head chip and FIG. 12B illustrates the second head chip;

FIGS. 13A and 13B are explanatory diagrams (cross-sectional views) for explaining the method of manufacturing the ink jet head, wherein FIG. 13A illustrates the first head chip and FIG. 13B illustrates the second head chip;

FIGS. 14A and 14B are explanatory diagrams (cross-sectional views) for explaining the method of manufacturing the ink jet head, wherein FIG. 14A illustrates the first head chip and FIG. 14B illustrates the second head chip;

FIGS. 18A and 18B are explanatory diagrams (perspective views) for explaining the method of manufacturing the ink jet head, wherein FIG. 18A illustrates the first head chip and FIG. 18B illustrates the second head chip;

FIGS. 19A and 19B are explanatory diagrams (perspective views) for explaining the method of manufacturing the ink jet head, wherein FIG. 19A illustrates the first head chip and FIG. 19B illustrates the second head chip;

FIGS. 20A and 20B are explanatory diagrams (perspective views) for explaining the method of manufacturing the ink jet head, wherein FIG. 20A illustrates the first head chip and FIG. 20B illustrates the second head chip.

DETAILED DESCRIPTION

Figure 1:
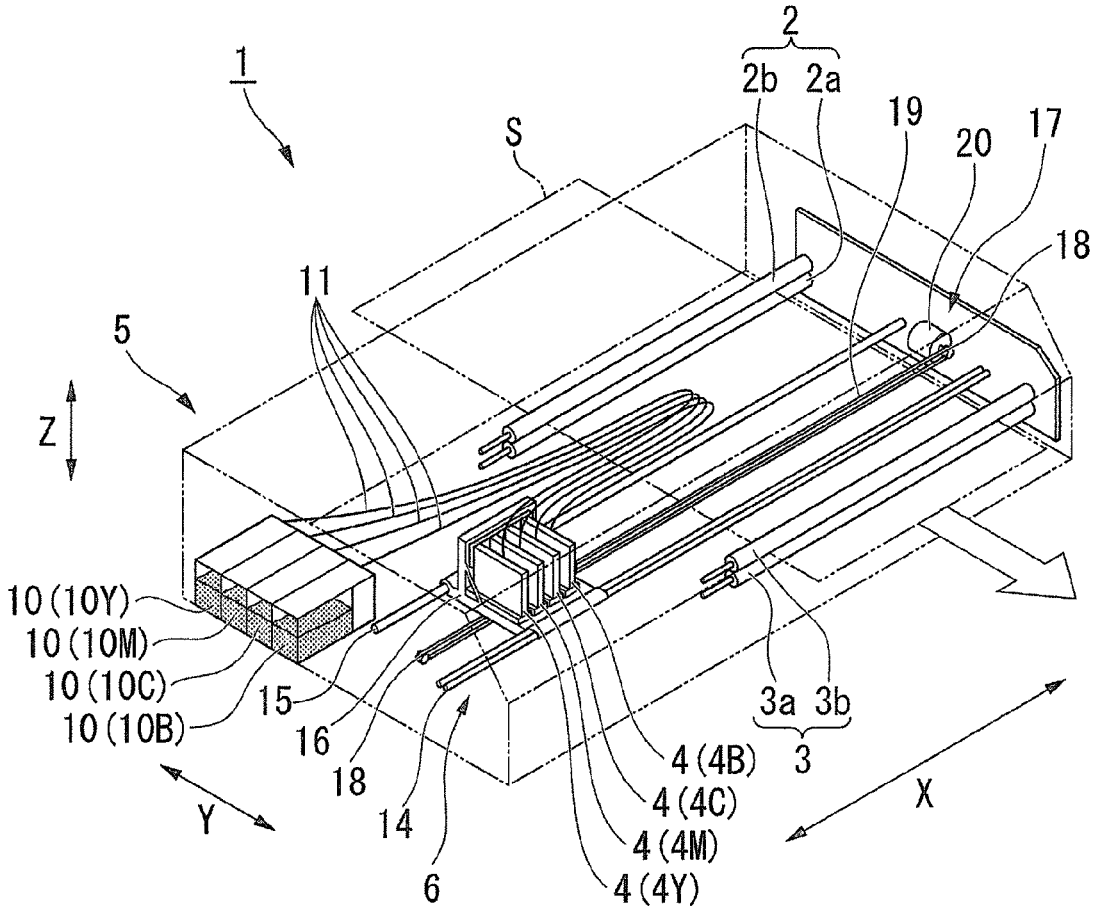
FIG. 1 is a perspective view of an ink jet printer in an embodiment.

Hereinbelow, an embodiment according to the present invention will be described with reference to the drawings. In the following embodiment, an ink jet printer (hereinbelow, just referred to as "printer") which performs recording on a recording medium such as recording paper using ink (liquid) will be described as an example of a liquid jet apparatus provided with a liquid jet head of the present invention. In the drawings used in the following description, the scale of each component is appropriately changed so as to allow each component to have a recognizable size.

[Printer]

FIG. 1 is a perspective view of a printer 1.

As illustrated in FIG. 1, the printer 1 is provided with a pair of conveyance mechanisms (movement mechanisms) 2 and 3 which conveys a recording medium S such as paper, a plurality of inkjet heads (liquid jet heads) 4 each of which jets ink droplets onto the recording medium S, an ink supply unit 5 which supplies ink to the ink jet heads 4, and a scanning unit 6 which moves the ink jet heads 4 in a direction (sub-scanning direction) that is perpendicular to a conveyance direction of the recording medium S (main-scanning direction).

In the following description, the sub-scanning direction is referred to as an X direction, the main-scanning direction is referred to as a Y direction, and a direction that is perpendicular to the X direction and the Y direction is referred to as a Z direction. The printer 1 is mounted to be used with the X and Y directions aligned with the horizontal direction and the Z direction aligned with the vertical direction.

The conveyance mechanism 2 includes a grid roller 2*a* which extends in the X direction, a pinch roller 2*b* which extends in parallel to the grid roller 2*a*, and a drive mechanism (not illustrated), for example, a motor which allows the grid roller 2*a* to rotate around a shaft thereof. Similarly, the conveyance mechanism 3 includes a grid roller 3*a* which extends in the X direction, a pinch roller 3*b* which extends in parallel to the grid roller 3*a*, and a drive mechanism (not illustrated), for example, a motor which allows the grid roller 3*a* to rotate around a shaft thereof.

The ink supply unit 5 is provided with a plurality of ink tanks 10 each of which stores ink therein and a plurality of ink supply tubes 11 which connect the ink tanks 10 to the respective ink jet heads 4. The ink tanks 10 include, for example, ink tanks 10Y, 10M, 10C, and 10B which respectively store therein four colors of ink: yellow, magenta, cyan, and black.

The ink tanks 10Y, 10M, 10C, and 10B are arrayed along the Y direction. The ink supply tubes 11 are, for example, flexible hoses having flexibility and capable of following the action (movement) of a carriage 16 which supports the ink jet heads 4. The ink tanks 10 are not limited to the ink tanks 10Y, 10M, 10C, and 10B which respectively store therein four colors of ink: yellow, magenta, cyan, and black, and may include ink tanks which store therein more than four colors of ink.

The scanning unit 6 is provided with a pair of guide rails 14 and 15 which extend in the X direction and are arranged in parallel to each other with an interval therebetween in the Y direction, the carriage 16 which is arranged to be movable along the pair of guide rails 14 and 15, and a drive mechanism 17 which moves the carriage 16 in the X direction.

The drive mechanism 17 is provided with a pair of pulleys 18 which are arranged between the guide rails 14 and 15 with an interval between the pulleys 18 in the X direction, an endless belt 19 which is wound around the pair of pulleys 18 and moves in the X direction, and a drive motor 20 which drives one of the pulleys 18 to rotate.

The carriage 16 is coupled to the endless belt 19 and movable in the X direction along with the movement of the endless belt 19 caused by driving the pulley 18 to rotate. The ink jet heads 4 arranged side by side in the X direction are mounted on the carriage 16. In the illustrated example, four ink jet heads 4, specifically, ink jet heads 4Y, 4M, 4C, and 4B which respectively eject yellow (Y) ink, magenta (M) ink, cyan (C) ink, and black (B) ink are mounted on the carriage 16. The conveyance mechanisms 2 and 3 and the scanning unit 6 constitute a movement mechanism which relatively moves the ink jet heads 4 and the recording medium S.

(Ink Jet Head)

Figure 2:
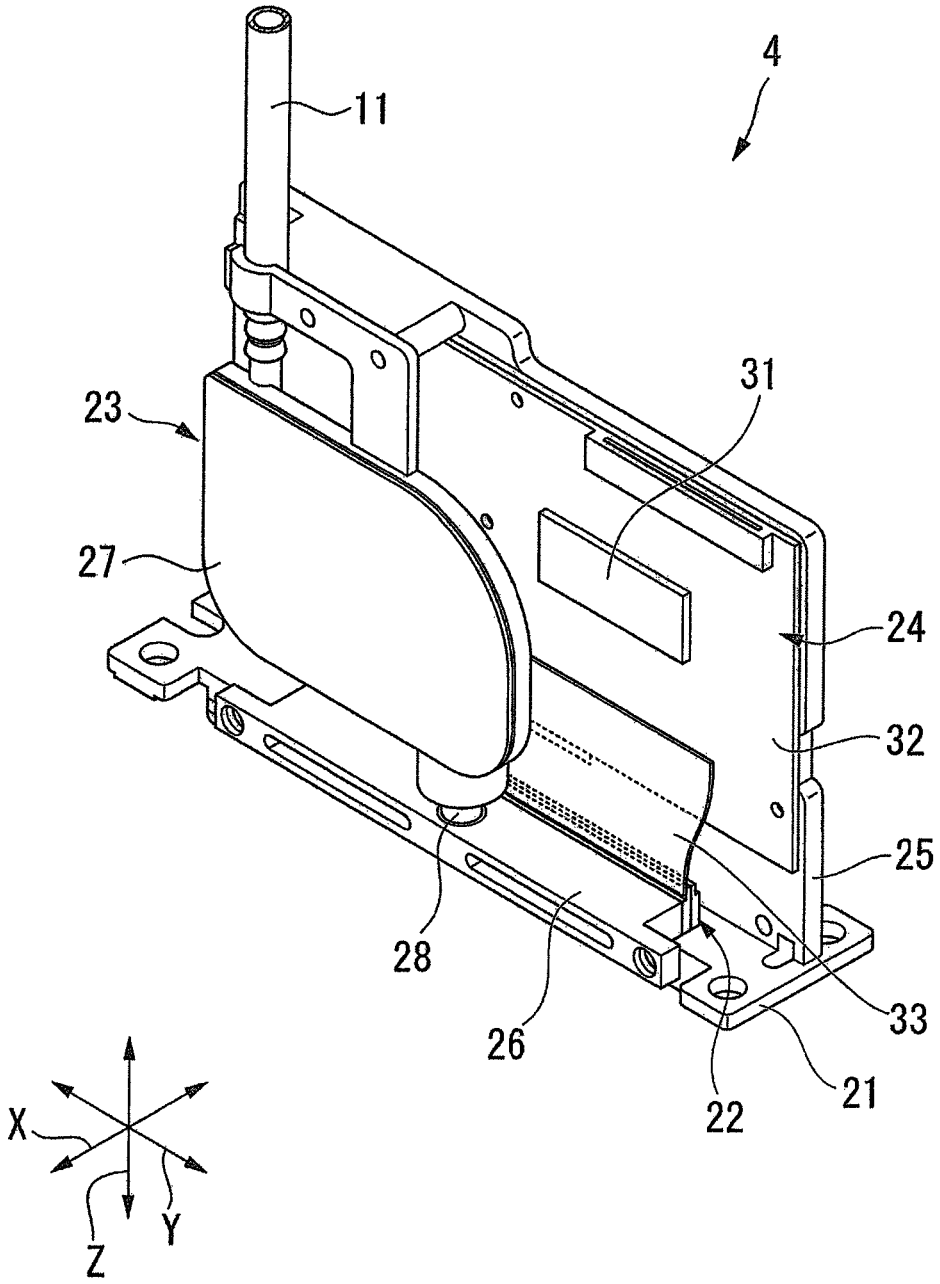
FIG. 2 is a perspective view of an ink jet head.

Next, the ink jet head 4 will be specifically described. FIG. 2 is a perspective view of the ink jet head 4. All of the ink jet heads 4 described above have the same configuration excepting the color of ink supplied thereto. Thus, in the following description, one of the ink jet heads 4 will be described.

As illustrated in FIG. 2, the ink jet head 4 is provided with a fixation plate 21 which is fixed to the carriage 16, an ejecting portion 22 which is fixed onto the fixation plate 21, an ink supply portion 23 which supplies ink supplied from the ink supply unit 5 further to a common ink chamber 63 (described below) of the ejecting portion 22, and a head drive portion 24 which applies drive voltage to the ejecting portion 22.

Applying drive voltage to the ink jet head 4 causes the ink jet head 4 to eject a predetermined amount of ink of the corresponding color. At this point, moving the ink jet head 4 in the X direction by the scanning unit 6 enables recording in a predetermined range of the recording medium S. Repeatedly performing the scanning while conveying the recording medium S in the Y direction by the conveyance mechanisms 2 and 3 makes it possible to perform recording on the entire recording medium S.

A support plate 25 which is made of metal, for example, aluminum is fixed, in a standing form along the Z direction, to the fixation plate 21. Further, a flow path member 26 which supplies ink to the ejecting portion 22 is fixed to the fixation plate 21. A pressure buffer 27 which has a storage chamber for storing ink inside thereof is supported by the support plate 25 and arranged above the flow path member 26. The flow path member 26 and the pressure buffer 27 are coupled to each other through an ink coupling tube 28. The ink supply tube 11 (described above) of the ink supply unit 5 is connected to the pressure buffer 27.

When ink is supplied to the pressure buffer 27 through the ink supply tube 11, the pressure buffer 27 temporarily stores the ink inside the storage chamber arranged inside thereof, and then supplies a predetermined amount of ink to the ejecting portion 22 through the ink coupling tube 28 and the flow path member 26.

The flow path member 26, the pressure buffer 27, and the ink coupling tube 28 constitute the ink supply portion 23 described above.

An IC board 32 is attached to the support plate 25. A control circuit (drive circuit) 31, for example, an integrated circuit for driving the ejecting portion 22 is mounted on the IC board 32. The control circuit 31 is electrically connected to drive electrodes (common electrodes 55, common terminals 56, individual electrodes 57, and individual terminals 58, described below) of the ejecting portion 22 through a flexible printed board 33 having a wiring pattern (not illustrated) printed thereon. Accordingly, the control circuit 31 can apply drive voltage to the drive electrodes 55 to 58 through the flexible printed board 33.

The IC board 32 having the control circuit 31 mounted thereon and the flexible printed board 33 constitute the head drive portion 24 described above.

(Ejecting Portion)

Figure 3:
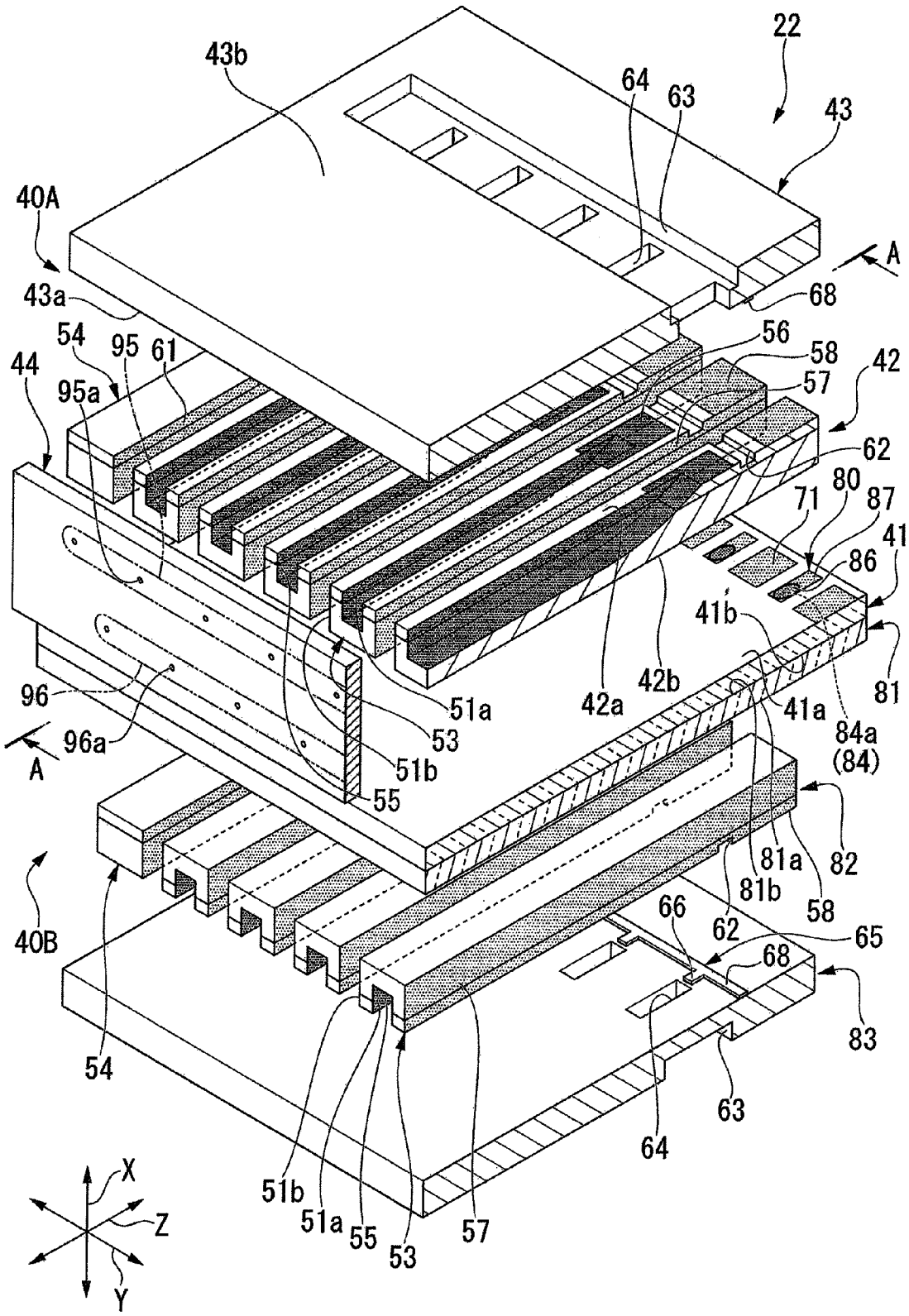
FIG. 3 is an exploded perspective view of an ejecting portion viewed from one side in the Z direction.
Figure 4:
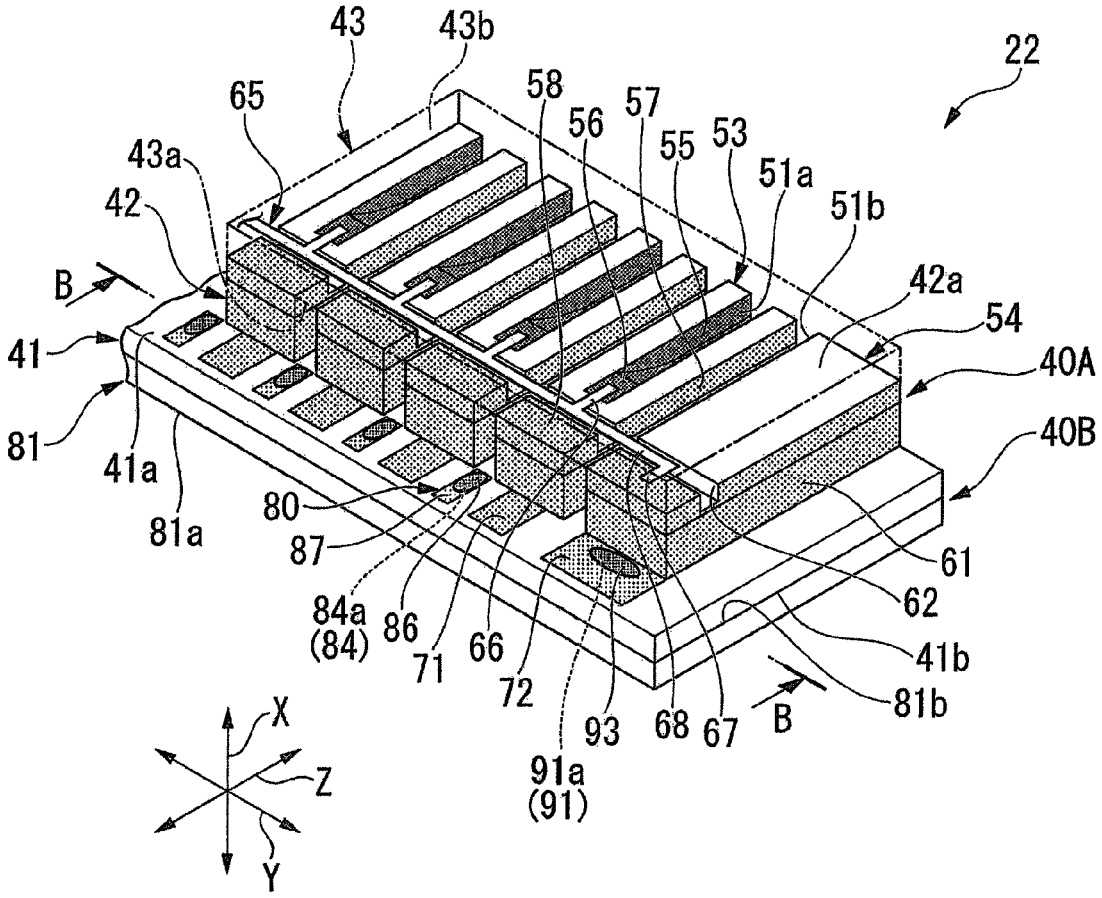
FIG. 4 is a perspective view of the ejecting portion viewed from a first head chip.
Figure 5:
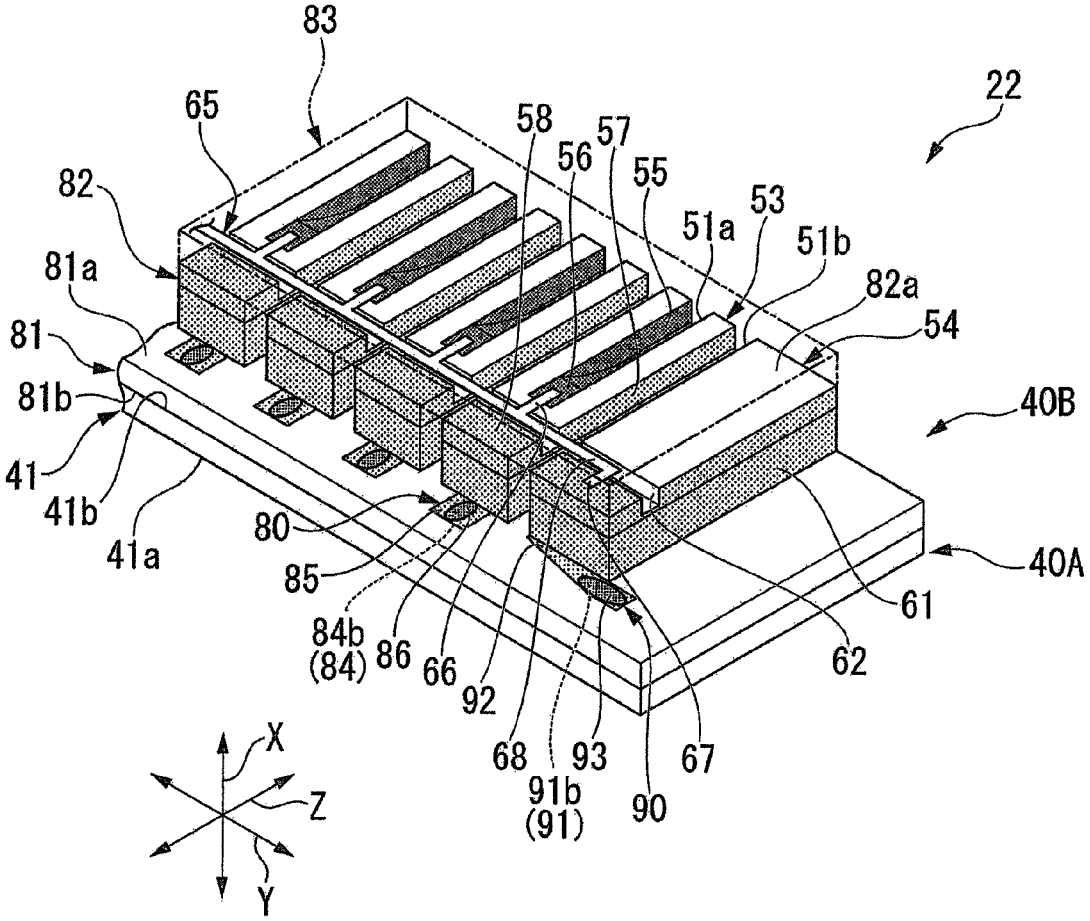
FIG. 5 is a perspective view of the ejecting portion viewed from a second head chip.
Figure 6:
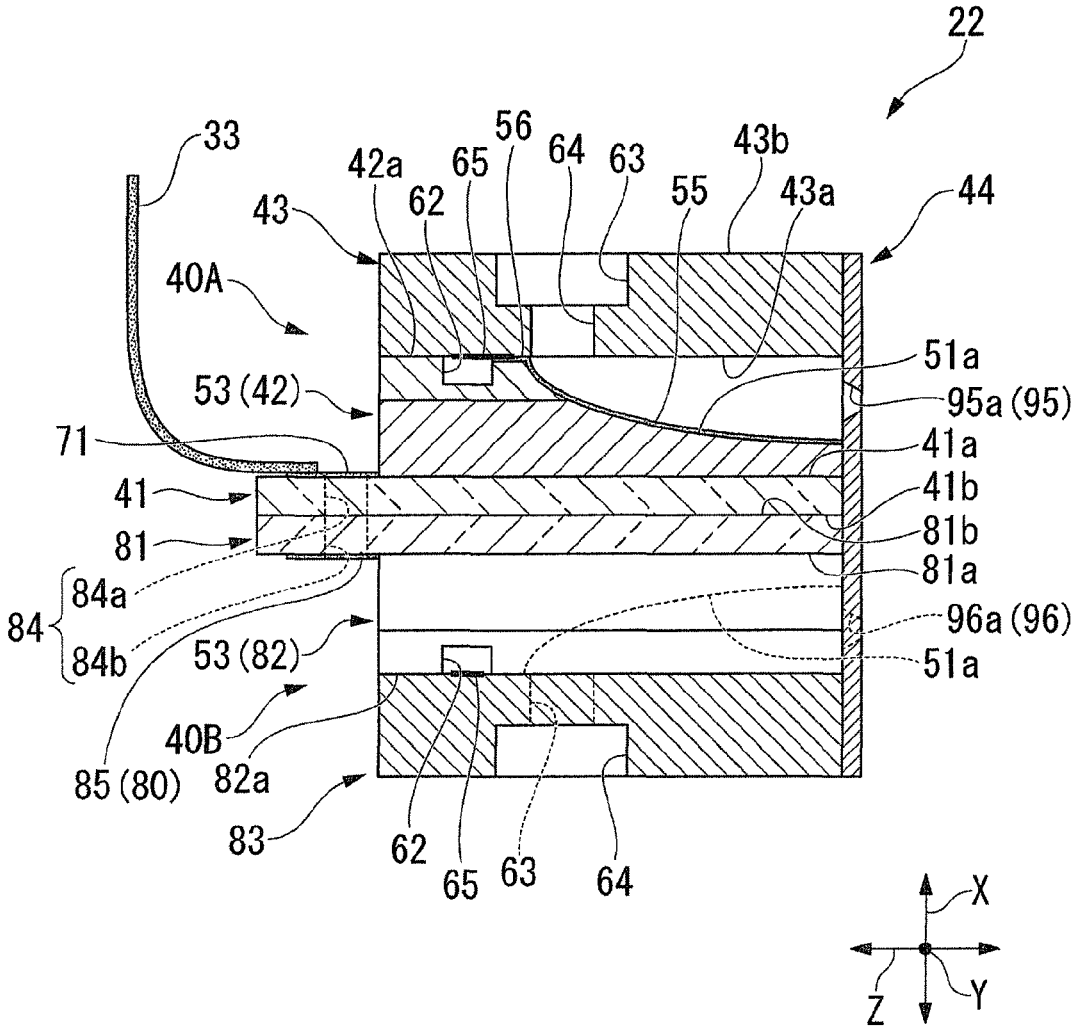
FIG. 6 is a cross-sectional view taken along line A-A of FIG. 3.
Figure 7:
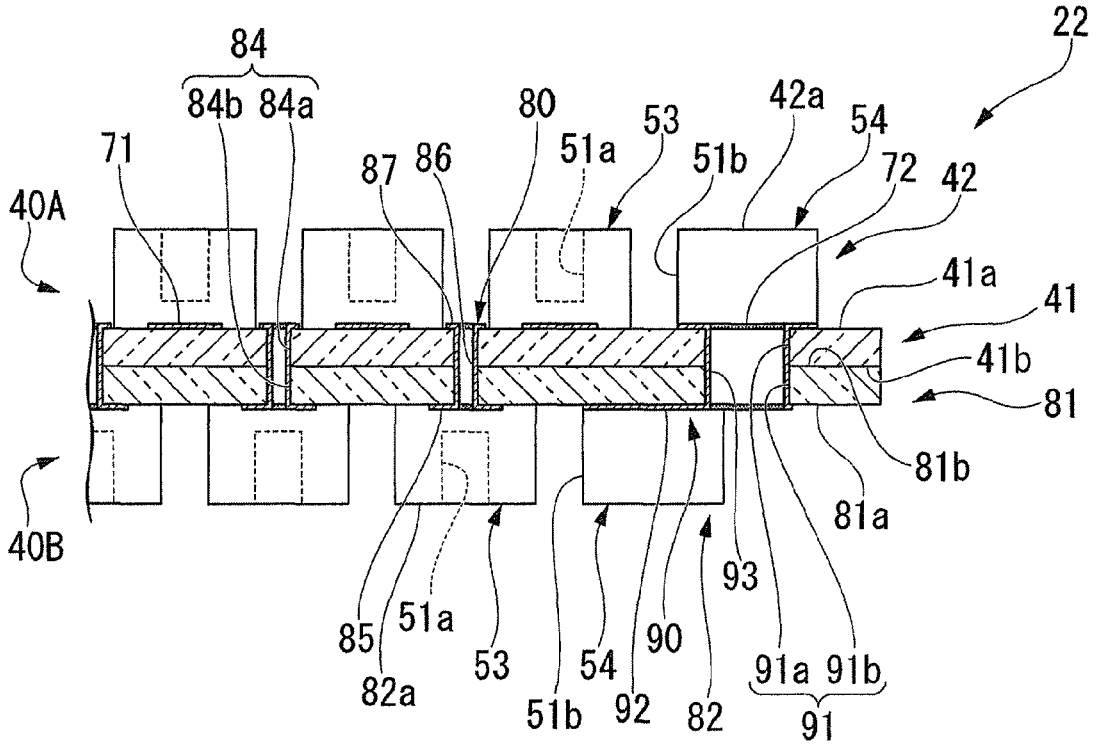
FIG. 7 is a cross-sectional view taken along line B-B of FIG. 4.

Next, the ejecting portion 22 will be specifically described. FIG. 3 is an exploded perspective view of the ejecting portion 22 viewed from one side in the Z direction. FIG. 4 is a perspective view of the ejecting portion 22 viewed from a first head chip 40A. FIG. 5 is a perspective view of the ejecting portion 22 viewed from the second head chip 40B. FIG. 6 is a cross-sectional view taken along line A-A of FIG. 3. FIG. 7 is a cross-sectional view taken along line B-B of FIG. 4.

As illustrated in FIGS. 3 to 7, the ejecting portion 22 of the present embodiment is a two-array type ejecting portion 22 which includes two nozzle arrays, specifically, a nozzle array 95 which has a plurality of first nozzle holes 95*a* and a nozzle array 96 which has a plurality of second nozzle holes 96*a*. Specifically, the ejecting portion 22 is provided with the first head chip 40A and the second head chip 40B which are laminated in the X direction and a nozzle plate 44 which is fixed to both the first head chip 40A and the second head chip 40B. In the following description, a side in the Z direction on which the nozzle plate 44 is provided is referred to as "front side", and the opposite side thereof is referred to as "rear side". Each of the head chips 40A and 40B is an edge shoot type head chip which ejects ink from ejection channels 51*a* (described below).

(First Head Chip)

The first head chip 40A is provided with a first base plate (base plate) 41, a first actuator plate (first actuator portion) 42, and a first cover plate 43.

The first base plate 41 is composed of, for example, a dielectric body such as glass.

The first actuator plate 42 is a lamination plate which is formed by laminating two plates polarized in different directions in the thickness direction (X direction), that is, a so-called chevron type. The two plates are piezoelectric substrates, for example, PZT (lead zirconate titanate) ceramic substrates both polarized in the thickness direction (X direction), and bonded to each other with their polarized directions facing opposite sides.

The first actuator plate 42 is fixed to the first base plate 41 with, for example, adhesive at a position avoiding through holes 84 and 91 (described below) with the front end surface of the actuator plate 42 arranged flush with the front end surface of the first base plate 41. In plan view from the X direction, the first actuator plate 42 is smaller than the outer shape of the first base plate 41. Thus, both sides in the Y direction and a rear end part of the first base plate 41 project outward from the first actuator plate 42.

The first actuator plate 42 has a plurality of channels 51*a* and 51*b* which are recessed in the X direction and arranged side by side at predetermined intervals in the Y direction. The channels 51*a* and 51*b* are open on a first principal surface 42*a* of the first actuator plate 42 and linearly extend along the Z direction.

Specifically, the channels 51*a* and 51*b* are roughly classified into ejection channels 51*a* which are filled with ink and dummy channels 51*b* which are not filled with ink. The ejection channels 51*a* and the dummy channels 51*b* are alternately arranged side by side in the Y direction.

The dummy channels 51*b* penetrate the first actuator plate 42 in the X direction and the Z direction and divide the first actuator plate 42 in the Y direction. In the first actuator plate 42, portions located between the dummy channels 51*b* adjacent to each other in the Y direction constitute central blocks 53, and portions located on the outer side in the Y direction with respect to the outermost dummy channels 51*b* in the Y direction constitute a pair of outer blocks 54. In the illustrated example, only one of the outer blocks 54 is illustrated.

On the other hand, the ejection channels 51*a* are formed on the respective central blocks 53 and open in the X and Z directions on the first actuator plate 42. Thus, drive walls which define each of the ejection channels 51*a* are formed on each of the central blocks 53 on both sides thereof in the Y direction with respect to the ejection channel 51*a*. Each of the drive walls has a rectangular cross section and extends in the Z direction. The drive walls partition the ejection channels 51*a* and the dummy channels 51*b* from each other. In the illustrated example, a rear end part of each of the ejection channels 51*a* becomes gradually shallower toward the rear side.

A common electrode 55 is formed on an inner surface, that is, a pair of side wall surfaces facing each other in the Y direction and a bottom wall surface of each of the ejection channels 51*a*. The common electrodes 55 extend in the Z direction along the respective ejection channels 51*a* and are in conduction with common terminals 56 which are formed on the first principal surfaces 42*a* of the respective central blocks 53. The common terminals 56 are electrically independently pattern-formed.

On the other hand, individual electrodes 57 are formed on outer side surfaces of the central blocks 53 (that is, side wall surfaces facing each other in the Y direction in inner surfaces of the dummy channels 51*b*) throughout the entire area thereof. The individual electrodes 57 are connected to individual terminals 58 (refer to FIG. 4) which are formed on the first principal surfaces 42*a* and the rear end surfaces of the central blocks 53 at the rear end parts of the central blocks 53. Thus, a pair of individual electrodes 57 formed on the outer side surfaces of each of the central blocks 53 are connected to each other through the corresponding individual terminal 58. The individual electrodes 57 are not formed on bottom wall surfaces in the inner surfaces of the dummy channels 51*b* (that is, not formed on the base plate 41) and thus separated between the side wall surfaces facing each other in the Y direction. The common electrodes 55, the common terminals 56, the individual electrodes 57, and the individual terminals 58 constitute the drive electrodes 55 to 58 of the first head chip 40A.

Ground terminals 61 are formed on outer surfaces of the outer blocks 54. In the illustrated example, the ground terminals 61 are formed on the first principal surfaces 42*a*, the outer surfaces, and the rear end surfaces of the respective outer blocks 54. However, the ground terminals 61 may be formed at least on the first principal surfaces 42*a* and the rear end surfaces of the respective outer blocks 54.

A groove 62 which extends along the Y direction is formed between the common terminals 56 and the individual terminals 58 on the first principal surface 42*a* of the first actuator plate 42 (the central blocks 53 and the outer blocks 54). The groove 62 is recessed in the Z direction and separates the common terminals 56 from the individual terminals 58.

As illustrated in FIGS. 3 and 6, a first principal surface 43*a* of the first cover plate 43 is bonded to the first principal surface 42*a* of the first actuator plate 42. The first head chip 40A may mistakenly collide against a manufacturing jig or the like. In this case, if the rear end side of the first actuator plate 42 is exposed, a crack or fracture may be generated on the rear end side of the first actuator plate 42, which may cause breaks of the individual terminals 58. In order to prevent such a problem, the first cover plate 43 is flush with the first actuator plate 42 in a ZY plane. The outer shape of the first cover plate 43 in plan view from the X direction conforms with the outer shape of the entire first actuator plate 42 (the central blocks 53 and the outer blocks 54) in plan view from the X direction. That is, in the ZY plane, the first cover plate 43 covers the rear end side of the first actuator plate 42. Further, the first cover plate 43 includes a recessed common ink chamber 63 formed on a second principal surface 43*b* and a plurality of slits 64 which allow the common ink chamber 63 to communicate with the respective ejection channels 51*a*.

The common ink chamber 63 is located on a rear end part of the first cover plate 43. The common ink chamber 63 is a rectangular opening which is recessed toward the first actuator plate 42 in the X direction and extends along the Y direction. The common ink chamber 63 communicates with the flow path member 26 (refer to FIG. 2) so as to allow ink inside the flow path member 26 to flow to the common ink chamber 63.

The slits 64 are formed on the common ink chamber 63 at positions corresponding to the respective ejection channels 51*a*. Specifically, each of the slits 64 has a predetermined length in the Z direction. The rear end edge of each of the slits 64 is aligned with the rear end edge of the corresponding ejection channel 51*a* (an end point of an envelope shape of the ejection channel 51*a*) in the Z direction (refer to FIG. 6). This enables the introduction of ink inside the common ink chamber 63 into the ejection channels 51*a* and also restricts the introduction of ink inside the common ink chamber 63 into the dummy channels 51*b*. The above specific arrangement of the slits 64 prevents the ink from settling on the rear end side of each of the ejection channels 51*a*, thereby making it possible to prevent air bubbles from remaining inside the ejection channels 51*a*.

As illustrated in FIGS. 3 and 4, a connection wiring line 65 which connects each of the common terminals 56 to the ground terminals 61 is formed on the first principal surface 43*a* of the first cover plate 43. Specifically, the connection wiring line 65 includes common connection portions 66 which are connected to the respective common terminals 56, ground connection portions 67 which are connected to the respective ground terminals 61, and a main wiring line 68 which connects the common connection portions 66 and the ground connection portions 67 to each other.

The main wiring line 68 is formed on the first cover plate 43 at a position overlapping the groove 62 of the first actuator plate 42 in the X direction. The main wiring line 68 has a band-like shape extending along the Y direction. The main wiring line 68 is formed substantially throughout the entire length in the Y direction of the first cover plate 43 so as to extend between the pair of outer blocks 54 of the first actuator plate 42. Further, the width of the connection wiring line 65 (the width in the Z direction) is, for example, narrower than the width of the groove 62. The connection wiring line 65 is separated from the first actuator plate 42.

The common connection portions 66 are arrayed at intervals in the Y direction and extend in the Z direction in parallel to each other. In this case, an array pitch in the Y direction of the common connection portions 66 is equal to an array pitch of the ejection channels 51*a*. The front ends of the common connection portions 66 are connected to the respective common terminals 56. On the other hand, the rear ends of the common connection portions 66 are collectively connected to the main wiring line 68.

The ground connection portions 67 extend from opposite ends in the Y direction of the main wiring line 68 toward the rear side. The rear ends of the ground connection portions 67 are connected to the respective ground terminals 61 on the first principal surfaces 42*a* of the outer blocks 54.

As illustrated in FIGS. 3 to 7, first extraction electrodes, specifically, first individual extraction electrodes 71 which are connected to the respective individual terminals 58 and first ground extraction electrodes 72 which are connected to the respective ground terminals 61 are formed on the first principal surface 41*a* of the first base plate 41 at positions located on the rear side with respect to the first actuator plate 42.

The first individual extraction electrodes 71 are arrayed at intervals in the Y direction and extend in the Z direction in parallel to each other. In this case, an array pitch in the Y direction of the first individual extraction electrodes 71 is equal to an array pitch of the central blocks 53. The front ends of the first individual extraction electrodes 71 are connected to the respective individual terminals 58. The rear ends of the first individual extraction electrodes 71 are extracted to positions near the rear end edge of the base plate 41.

The front ends of the first ground extraction electrodes 72 are connected to the respective ground terminals 61. The rear ends of the first ground extraction electrodes 72 are extracted to positions near the rear end edge of the base plate 41. In the illustrated example, the width in the Y direction of each of the first individual extraction electrodes 71 is narrower than the width of each of the central blocks 53. The width in the Y direction of each of the ground extraction electrodes 72 is equal to the width of each of the outer blocks 54.

The area of each of the first ground extraction electrodes 72 is larger than the area of each of the first individual extraction electrodes 71. For example, as illustrated in FIG. 4, the length of each of the first ground extraction electrodes 72 is equal to the length of each of the first individual extraction electrodes 71 in the Z direction. On the other hand, the length of each of the first ground extraction electrodes 72 is longer than the length of each of the first individual extraction electrodes 71 in the Y direction.

Figure 16:
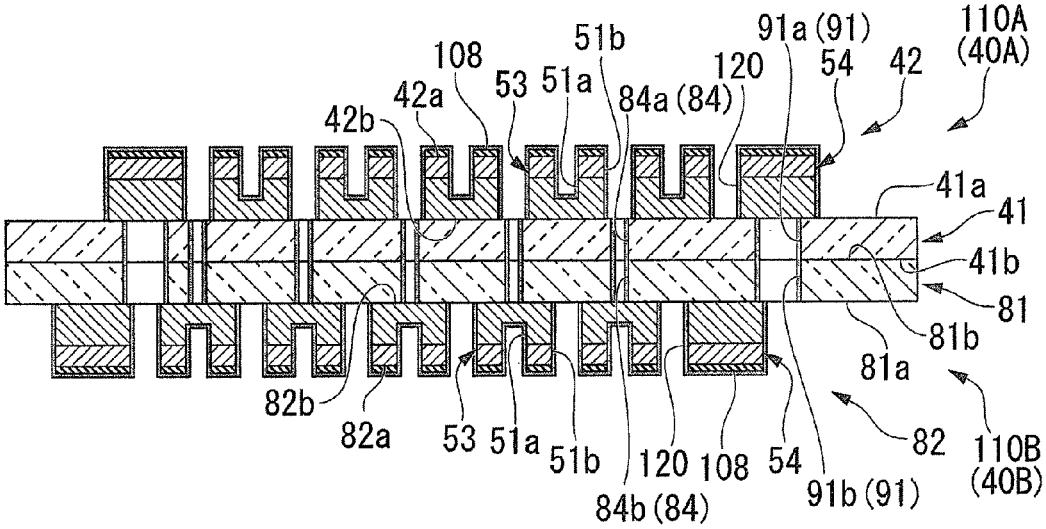
FIG. 16 is an explanatory diagram (cross-sectional view) for explaining the method of manufacturing the ink jet head.

The drive electrodes 55 to 58, the ground terminals 61, and the first extraction electrodes 71, 72 are integrally formed of a plating film 120 which is made of, for example, Ni/Au (refer to FIG. 16). In the first principal surface 41*a* of the first base plate 41, an electrode forming region in which the first extraction electrodes 71, 72 are formed has a larger surface roughness Ra than a region excepting the electrode forming region (non-forming region). In this case, the surface roughness Ra in the electrode forming region is preferably a value that enables the formation of the plating film 120, specifically, 400 Å or more. On the other hand, the surface roughness Ra in the non-forming region is desirably a value that does not enable the formation of the plating film, specifically, less than 100 Å. That is, in the present embodiment, the surface roughness Ra in the electrode forming region is preferably four times the surface roughness Ra in the non-forming region or more. In the present embodiment, the surface roughness Ra is a vale of arithmetic average roughness Ra standardized in JIS B0601. The drive electrodes 55 to 58, 61, and the first extraction electrodes 71, 72 constitute first electrodes for driving the first actuator plate 42.

(Second Head Chip)

The second head chip 40B is provided with second base plate 81, a second actuator plate (second actuator portion) 82, and a second cover plate 83. In the second head chip 40B, configurations similar to the configurations of the first head chip 40A will be denoted by the same reference numerals, and description thereof will be omitted.

The first head chip 40A and the second head chip 40B are laminated in the X direction in such a manner that a second principal surface 41*b* of the base plate 41 and a second principal surface 81*b* of the base plate 81 are bonded to each other. That is, the ejecting portion 22 of the present embodiment includes the first actuator plate 42 and the second actuator plate 82 which are disposed on opposite sides in the X direction of the bonded first and second base plates 41, 81.

Central blocks 53 and outer blocks 54 of the second actuator plate 82 are arrayed with shifted by a half pitch from the array pitch of the central blocks 53 and the outer blocks 54 of the first actuator plate 42. Thus, similarly, ejection channels 51*a* and dummy channels 51*b* of the second head chip 40B are also arrayed with shifted by a half pitch from the array pitch of the ejection channels 51*a* and the dummy channels 51*b* of the first head chip 40A. That is, in the ejecting portion 22 of the present embodiment, the ejection channels 51*a* of the first actuator plate 42 and the ejection channels 51*a* of the second actuator plate 82 are arranged in a staggered form. Further, drive electrodes 55 to 58 and ground terminals 61 having the same patterns as those of the first actuator plate 42 are formed on the second actuator plate 82.

As illustrated in FIGS. 5 to 7, second individual extraction electrodes 80 of the second head chip 40B are routed to the first principal surface 41*a* of the first base plate 41 through individual through holes (through holes) 84 which penetrate the first base plate 41 and the second base plate 81. Specifically, each of the second individual extraction electrodes 80 includes an extraction portion 85 which is formed on a first principal surface 81*a* of the second base plate 81, a through portion 86 which is formed inside the individual through hole 84, and a land portion 87 which is formed on the first principal surface 41*a* of the first base plate 41.

Each of the individual through holes 84 has an elliptical shape whose short axis is aligned with the Y direction. The individual through holes 84 are open on the first base plate 41 at positions behind the respective dummy channels 51*b* (between the first extraction electrodes 71 in the Y direction), and open on the second base plate 81 at positions behind the respective central block 53. Specifically, the individual through holes 84 include first through holes (through holes) 84*a* which penetrate the first base plate 41 and second through holes (through holes) 84*b* which penetrate the second base plate 81 and have the same array pitch in the Y direction as the first through holes 84*a*. The first through holes 84*a* and the second through holes 84*b* which correspond to each other in the Y direction overlap in the X direction to form the individual through holes 84 which penetrate both the base plates 41 and 81 in the X direction. Each of the individual through holes 84 has a width equal to the width of each of the dummy channels 51*b* in the Y direction.

Further, the through portion 86 which penetrates the base plates 41 and 81 in the X direction is formed on the inner surface of each of the individual through holes 84 by the plating film 120.

The extraction portions 85 are arrayed at intervals in the Y direction and extend in the Z direction in parallel to each other on the first principal surface 81*a* of the second base plate 81. Specifically, the front ends of the extraction portions 85 are connected to the respective individual terminals 58. The extraction portions 85 surround the respective individual through holes 84 (second through holes 84*b*) and are connected to the respective through portions 86. An array pitch in the Y direction of the extraction portions 85 is equal to an array pitch of the central blocks 53.

Each of the land portions 87 is located on the first principal surface 41*a* of the first base plate 41 at a position between first individual extraction electrodes 71 adjacent to each other in the Y direction and extends rearward from the corresponding through portion 86. Thus, the first individual extraction electrodes 71 and the land portions 87 of the second individual extraction electrodes 80 are alternately arrayed on the first principal surface 41*a* of the first base plate.

As illustrated in FIGS. 5 and 7, second ground extraction electrodes 90 of the second head chip 40B are routed to the first principal surface 41*a* of the first base plate 41 through ground through holes (through holes) 91 which penetrate the first base plate 41 and the second base plate 81. Specifically, each of the second ground extraction electrodes 90 includes an extraction portion 92 which is formed on the first principal surface 81*a* of the second base plate 81 and a through portion 93 which is formed inside the corresponding ground through hole 91.

Each of the ground through holes 91 has an elliptical shape whose long axis is aligned with the Y direction. The ground through holes 91 are open on the first base plate 41 at positions behind the respective outer blocks 54 (positions corresponding to the respective ground extraction electrodes 72 in the Y direction) and open on the second base plate 81 with partially displaced in the Y direction from the respective outer blocks 54. Specifically, the ground through holes 91 include first through holes (through holes) 91*a* which penetrate the first base plate 41 and second through holes (through holes) 91*b* which penetrate the second base plate 81 and have the same array pitch in the Y direction as the first through holes 91*a*. The first through holes 91*a* and the second through holes 91*b* which correspond to each other in the Y direction overlap in the X direction to form the ground through holes 91 which penetrate both the base plates 41 and 81 in the X direction.

A through portion 93 which penetrates the base plates 41 and 81 in the X direction is formed on the inner surface of each of the ground through holes 91 by the plating film 120. One end of each of the through portions 93 in the X direction is connected to the corresponding first ground extraction electrode 72 on the first principal surface 41*a* of the first base plate 41, and the other end thereof is connected to the corresponding extraction portion 92 on the first principal surface 81*a* of the second base plate 81.

One end of each of the extraction portions 92 is connected to the corresponding ground terminal 61 on the first principal surface 81*a* of the second base plate 81, and the other end thereof is connected to the corresponding through portion 93.

As illustrated in FIG. 6, the flexible printed board 33 is connected to the rear end of the first base plate 41. A wiring pattern (not illustrated) is formed on the flexible printed board 33. The wiring pattern is connected to the first individual extraction electrodes 71, the first ground extraction electrodes 72, and the land portions 87 of the second individual extraction electrodes 80 on the first principal surface 41*a* of the first base plate 41. In this case, the flexible printed board 33 is in conduction with the second ground extraction electrodes 90 through the first ground extraction electrodes 72. Further, the drive electrodes 55 to 58, 61 and the second extraction electrodes 80, 90 constitute second electrodes for driving the second actuator plate 82.

The nozzle plate 44 is a film-like member made of a resin material such as polyimide. The nozzle plate 44 is fixed to the front end surfaces of the first head chip 40A and the second head chip 40B with, for example, adhesive. The nozzle plate 44 includes the two nozzle arrays (the first nozzle array 95 and the second nozzle array 96) each having a plurality of nozzle holes (the first nozzle holes 95*a* and the second nozzle holes 96*a*) arranged side by side at intervals in the Y direction.

The first nozzle array 95 has the first nozzle holes 95*a* which penetrate the nozzle plate 44 in the Z direction. The first nozzle holes 95*a* are arranged side by side on a straight line at intervals in the Y direction. The first nozzle holes 95*a* communicate with the respective ejection channels 51*a* of the first actuator plate 42.

The second nozzle array 96 has the second nozzle holes 96*a* which penetrate the nozzle plate 44 in the Z direction. The second nozzle array 96 is arranged in parallel to the first nozzle array 95. The second nozzle holes 96*a* communicate with the respective ejection channels 51*a* of the second actuator plate 82. Thus, the dummy channels 51*b* do not communicate with the nozzle holes 95*a* and 96*a*, and are covered by the nozzle plate 44 from the front side.

<Method of Operating Ink Jet Head>

Next, a method of operating the above ink jet head 4 will be described.

In the ink jet head 4, when drive voltage is applied to the drive electrodes 55 to 58 through the flexile printed board 33, two drive walls which define each of the ejection channels 51*a* are deformed to project toward the dummy channels 51*b* by a piezoelectric slide effect. That is, each of the actuator plates 42 and 82 of the present embodiment includes two laminated plates which are polarized in the thickness direction (X direction). Thus, applying the drive voltage causes deformation of the actuator plates 42 and 82 so as to be curved into a V shape from the central positions in the X direction of the drive walls. Accordingly, the ejection channels 51*a* are deformed as if they swell.

When the volume of each of the ejection channels 51*a* increases because of the deformation of the two drive walls, ink inside the common ink chamber 63 is guided into each of the ejection channels 51*a* through the corresponding slit 64. Then, the ink guided into the ejection channels 51*a* propagate inside the ejection channels 51*a* as pressure waves. At the timing when the pressure waves reach the nozzle holes 95*a* and 96*a*, the drive voltage applied to the drive electrodes 55 to 58 is made zero.

Accordingly, the drive walls return to the original shape and the temporarily increased volume of the ejection channels 51*a* thus return to the original volume. This operation increases the pressure inside the ejection channels 51*a*, so that the ink is pressurized. As a result, it is possible to eject the ink through the nozzle holes 95*a* and 96*a*. At this point, the ink is ejected as ink droplets in the form of liquid droplets when the ink passes through the nozzle holes 95*a* and 96*a*.

The method of operating the ink jet head 4 is not limited to the above operation. For example, the drive walls in a normal state maybe deformed toward the inner side of each of the ejection channels 51*a* as if each of the ejection channels 51*a* gets dented inward. This can be achieved by applying voltage that is positive-negative opposite to the above voltage to the drive electrodes 55 to 58, or oppositely polarizing piezoelectric elements of the actuator plates 42 and 82 when the positive/negative of the voltage is not changed. Further, each of the ejection channels 51*a* may be deformed to be dented inward after being deformed to swell outward to thereby increase the force for pressurizing ink during ejection.

In the ink jet head 4 of the present embodiment, the dummy channels 51*b* which are not filled with ink are arranged between the ejection channels 51*a*. Thus, ink is ejected from all of the ejection channels 51*a* at the same time (so called one-cycle type). Further, the arranged dummy channels 51*b* prevent a short circuit of the drive electrodes 55 to 58 through ink. This brings an effect such that various types of ink including a conductive ink such as a water-based ink can be used and excellent convenience can therefore be achieved.

<Method of Manufacturing Ink Jet Head>

Figure 8:
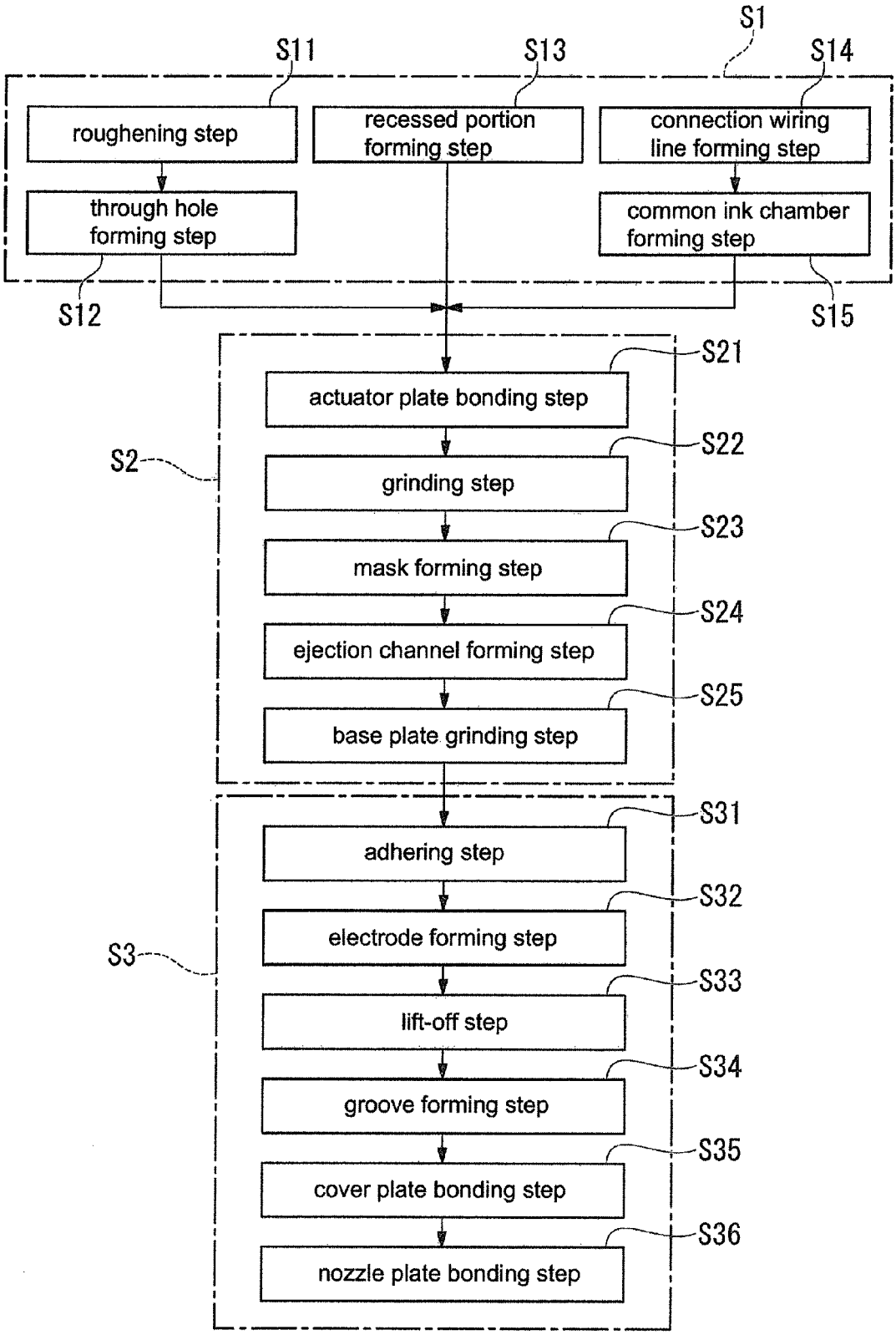
FIG. 8 is a flow chart for explaining a method of manufacturing the ink jet head.

Next, a method of manufacturing the ink jet head 4 will be described. FIG. 8 is a flow chart for explaining the method of manufacturing the ink jet head 4. FIGS. 9 to 20B are explanatory diagrams for explaining the method of manufacturing the ink jet head 4. FIGS. 9 to 17 are cross-sectional views. FIGS. 18A to 20B are perspective views. FIGS. 11A, 12A, 13A, 14A, 18A, 19A, and 20A illustrate the first head chip 40A. FIGS. 11B, 12B, 13B, 14B, 18B, 19B, and 20B illustrate the second head chip 40B. In the cross-sectional views of FIGS. 11A to 17, a cross-section passing through the through holes 84, 91 in the base plates 41, 81 and a cross section passing through the ejection channels 51*a* in the actuator plates 42, 82 are collectively illustrated for the purpose of illustration.

As illustrated in FIG. 8, the method of manufacturing the ink jet head 4 in the present embodiment includes a first step (S1), a second step (S2), and a third step (S3).

(First Step)

In the first step (S1), preparation before bonding is performed on the base plates 41, 81, the actuator plates 42, 82, and the cover plates 43, 83. In the first step (S1), processes for the base plates 41, 81, the actuator plates 42, 82, and the cover plates 43, 83 can be performed in parallel. In the following description, identical processes between the first head chip 40A and the second head chip 40B will be collectively described.

As preparation for each of the base plates 41, 81, the electrode forming regions are roughened on the first principal surface 41*a* of the base plate 41 and the first principal surface 81*a* of the base plate 81 (S11: roughening step). Specifically, the region corresponding to the first extraction electrodes 71, 72 and the land portions 87 of the second individual extraction electrodes 80 on the first principal surface 41*a* of the first base plate 41 is roughened using, for example, sandblast so as to have a surface roughness Ra that enables the formation of the plating film 120. Similarly, the electrode forming region (the region corresponding to the extraction portions 85, 92 of the second individual extraction electrodes 80, 90) on the first principal surface 81*a* of the second base plate 81 is roughened so as to have a surface roughness Ra that enables the formation of the plating film 120. In the roughening step (S11), the base plates 41, 81 may be roughened using, for example, etching or laser without using sandblast.

Figure 9:
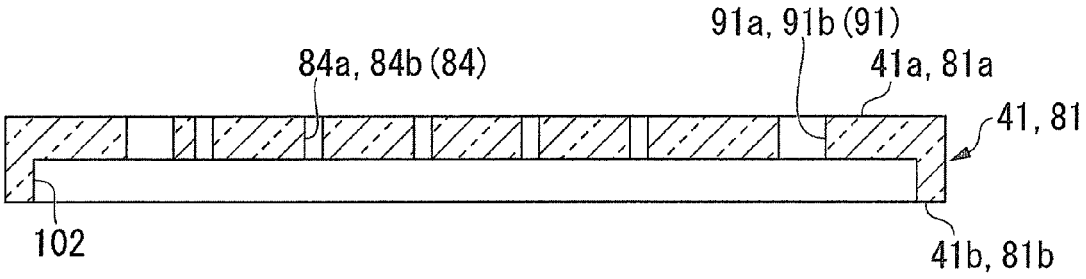
FIG. 9 is an explanatory diagram (cross-sectional view) for explaining the method of manufacturing the ink jet head.

Next, as illustrated in FIG. 9, the through holes 84, 91 are formed on each of the base plates 41, 81 using, for example, sandblast (S12: through hole forming step (boring step and processing step). Specifically, a communication groove portion 102 which extends along the Y direction is formed in a region for forming the through holes 84*a*, 91*a* on the base plate 41 from the second principal surface 41*b* and the through holes 84*a*, 91*a* each of which communicates with the communication groove portion 102 is formed from the first principal surface 41*a*. Similarly, a communication groove portion 102 which extends along the Y direction is formed in a region for forming the through holes 84*b*, 91*b* on the base plate 81 from the second principal surface 81*b* and the through holes 84*b*, 91*b* each of which communicates with the communication groove portion 102 is formed from the first principal surface 81*a*. Since the through hole forming step (S12) is performed using sandblast, the inner surfaces of the through holes 84*a*, 84*b*, 91*a*, 91*b* and regions around the through holes 84, 91 on the second principal surfaces 41*b*, 81*b* in the base plates 41, 81 are roughened to have the surface roughness Ra that enables the formation of the plating film 120. The through hole forming step (S12) may be performed using, for example, etching or drilling without using sandblast.

Figure 10:
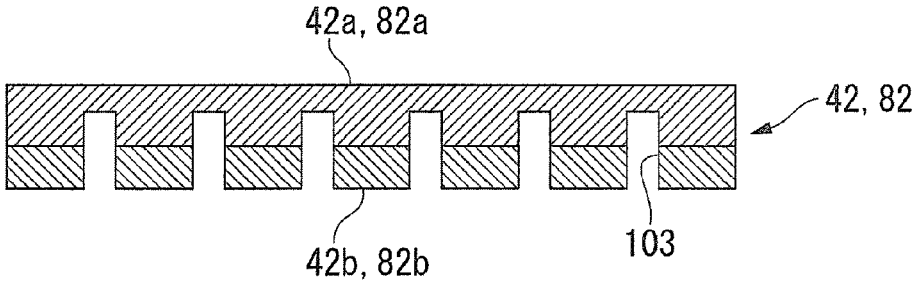
FIG. 10 is an explanatory diagram (cross-sectional view) for explaining the method of manufacturing the ink jet head.

Further, as illustrated in FIG. 10, as preparation for the actuator plates 42, 82, recessed portions 103 corresponding to the dummy channels 51*b* are formed on the second principal surfaces 42*b*, 82*b* of the actuator plates 42, 82 (S13: recessed portion forming step). Specifically, the recessed portions 103 which linearly extend along the Z direction are formed at intervals in the Y direction by, for example, cutting using dicing. The recessed portions 103 are formed to be open on opposite end surfaces in the Z direction of each of the actuator plates 42, 82. The depth in the X direction of the recessed portions 103 corresponds to the height in the X direction of the central blocks 53 and the outer blocks 54.

Further, as illustrated in FIG. 8, as preparation for the cover plates 43, 83, film formation such as deposition and plating is performed on the first principal surfaces 43*a*, 83*a* of the cover plates 43, 83 through a mask (not illustrated) to form the connection wiring lines 65 (refer to FIG. 4) (S14: connection wiring line forming step).

Then, for example, sandblast is performed on the cover plates 43, 83 to form the common ink chambers 63 and the slits 64 on the cover plates 43, 83 (S15: common ink chamber forming step).

(Second Step)

Figure 11A:
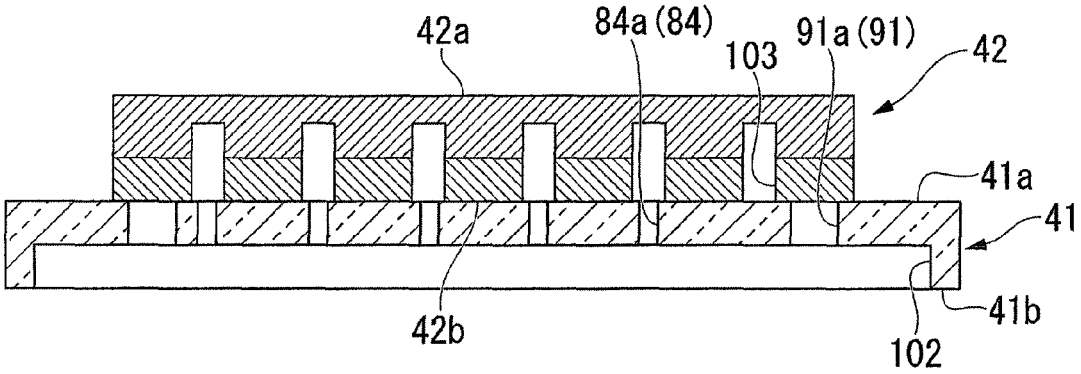
Figure 11B:
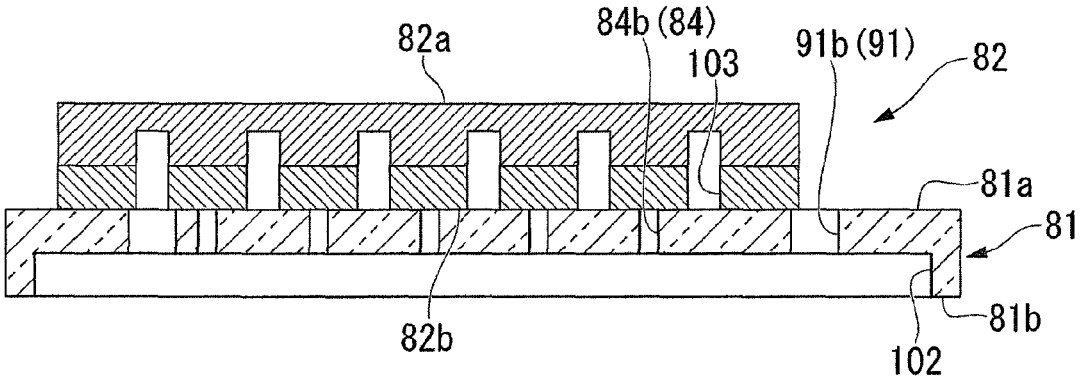
Figure 12A:
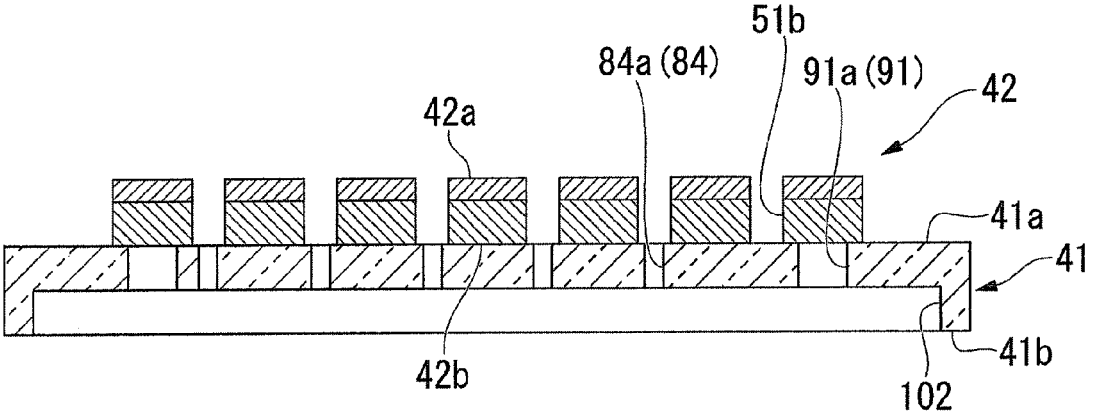
Figure 12B:
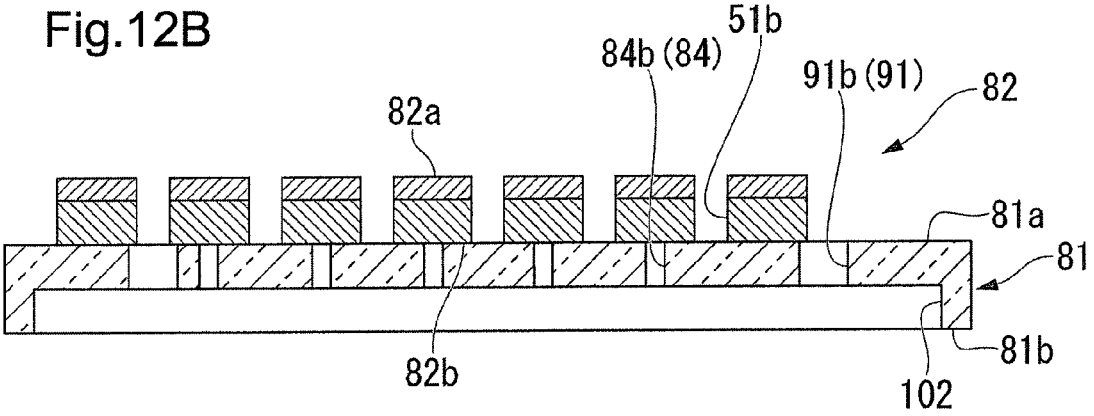
Figure 18A:
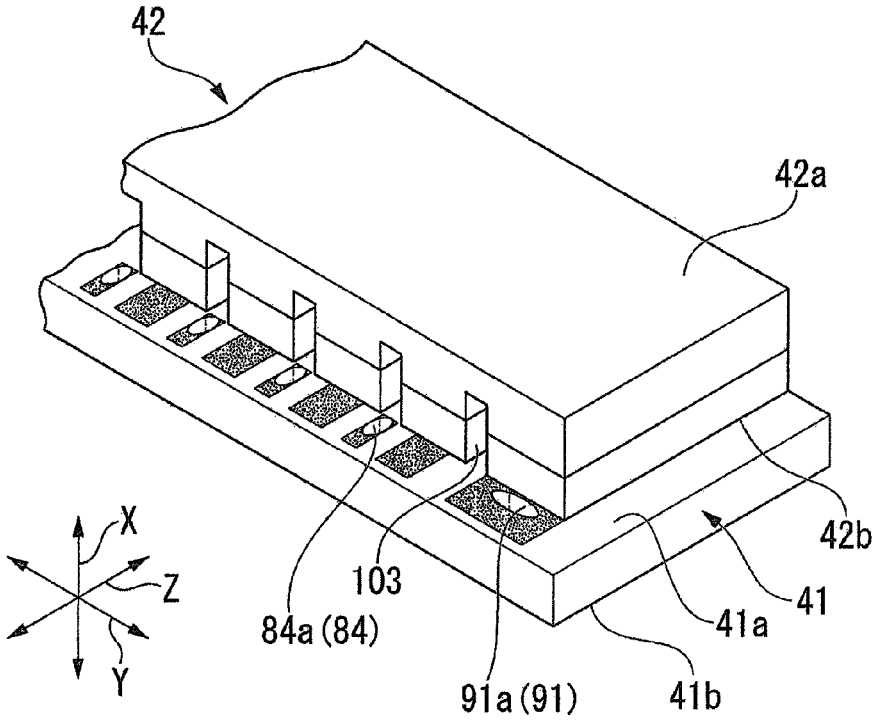
Figure 18B:
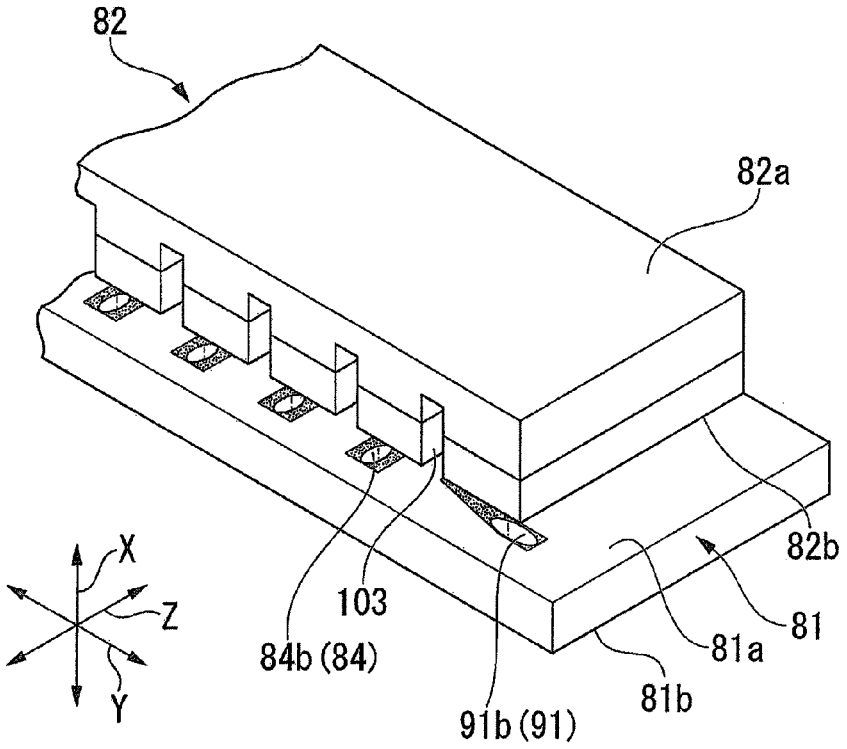
Figure 19A:
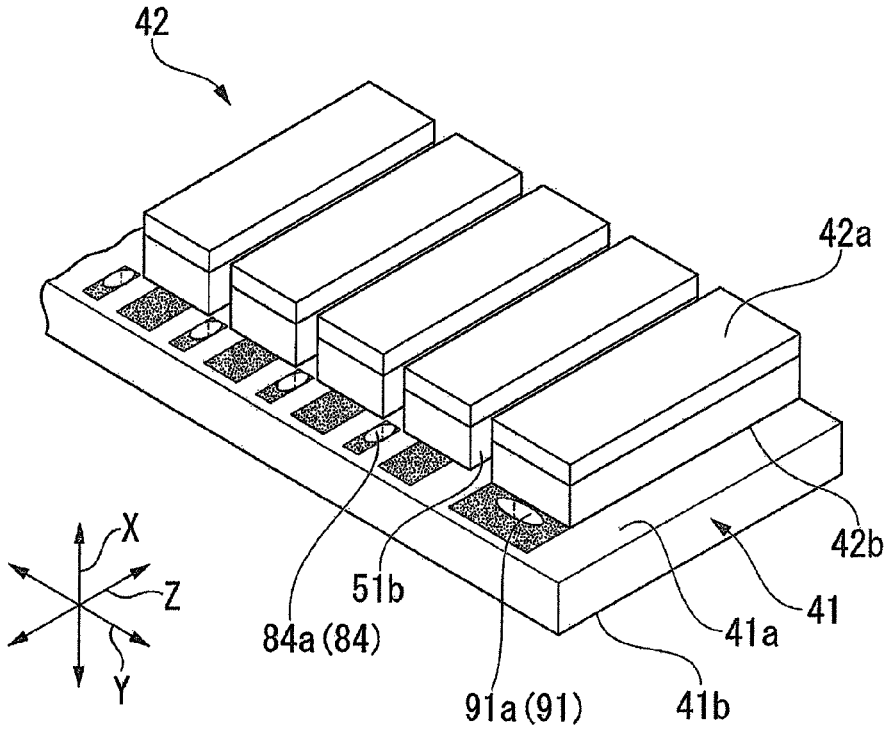
Figure 19B:
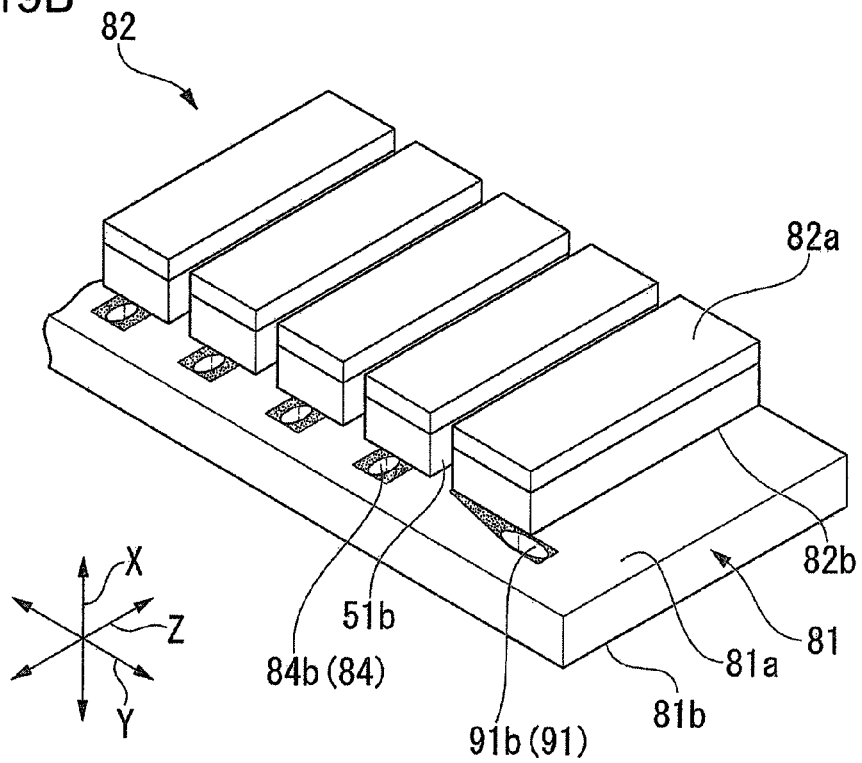

As illustrated in FIGS. 11A, 11B, 18A, and 18B, in the second step (S2), firstly, the base plate 41 and the actuator plate 42 are adhered together, and the base plate 81 and the actuator plate 82 are adhered together (S21: actuator plate bonding step (actuator portion disposing step)). At this point, the base plate 41 and the actuator plate 42 are aligned in a manner to align the rear end surface of the actuator plate 42 with the front end edges of the regions for forming the drive electrodes 55 to 58 (dotted regions in FIG. 18A) in the Z direction. Similarly, the base plate 81 and the actuator plate 82 are aligned in a manner to align the rear end surface of the actuator plate 82 with the front end edges of the regions for forming the drive electrodes 55 to 58 (dotted regions in FIG. 18B) in the Z direction. Thereafter, the plates 41 and 42 are adhered together, and the plates 81 and 82 are adhered together using, for example, adhesive. The alignment between the plates 41 and 42 and the alignment between the plates 81 and 82 may be performed in any manner as long as the rear end surface of the actuator plate 42 and the rear end surface of the actuator plate 82 are not separated, in the Z direction, from the front end edges of the regions for forming the drive electrodes 55 to 58 in the base plate 41 and the regions for forming the drive electrodes 55 to 58 in the base plate 81, respectively. That is, the alignment between the plates 41 and 42 and the alignment between the plates 81 and 82 may be performed in such a manner that the rear end surface of the actuator plate 42 and the rear end surface of the actuator plate 82 respectively overlap the front end edges of the regions for forming the drive electrodes 55 to 58 in the base plate 41 and the front end edges of the regions for forming the drive electrodes 55 to 58 in the base plate 81 in the Z direction. At this point, as illustrated in FIGS. 11A and 18A, the alignment between the first base plate 41 and the first actuator plate 42 is performed in a manner to position the recessed portions 103 corresponding to the through holes 84*a*, 91*a* in the Y direction. On the other hand, as illustrated in FIGS. 11B and 18B, the alignment between the second base plate 81 and the second actuator plate 82 is performed in a manner to position the through holes 84*b*, 91*b* between the recessed portions 103 in the Y direction.

Then, as illustrated in FIGS. 12A, 12B, 19A, and 19B, the first principal surfaces 42*a*, 82*a* of the actuator plates 42, 82 are ground by, for example, a grinder to allow the recessed portions 103 to penetrate the actuator plates 42, 82 (S22: grinding step). Accordingly, each of the actuator plates 42, 82 is separated into the central blocks 53 and the outer blocks 54, and the dummy channels 51*b* are formed between the central blocks 53 and between the central block 53 and the outer block 54. In the present embodiment, principal surfaces of the actuator plates 42, 82, the principal surfaces being located opposite to the base plates 41, 81, are referred to as the first principal surfaces 42*a*, 82*a* in any state.

Figure 13A:
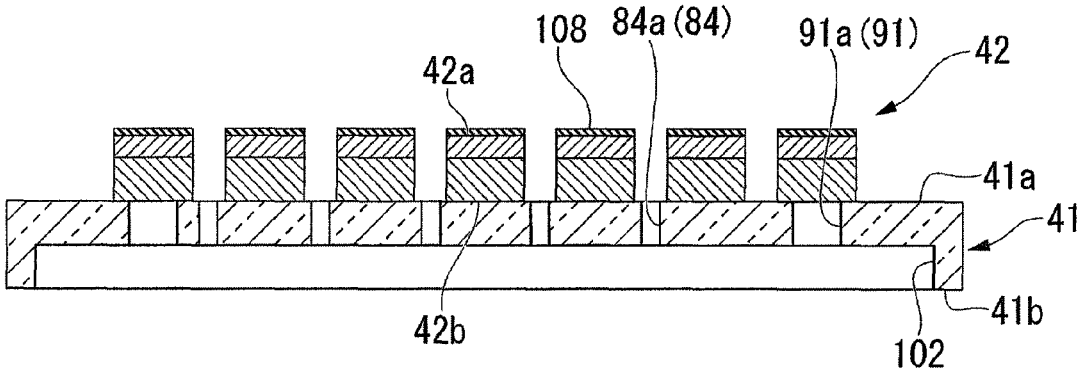
Figure 13B:
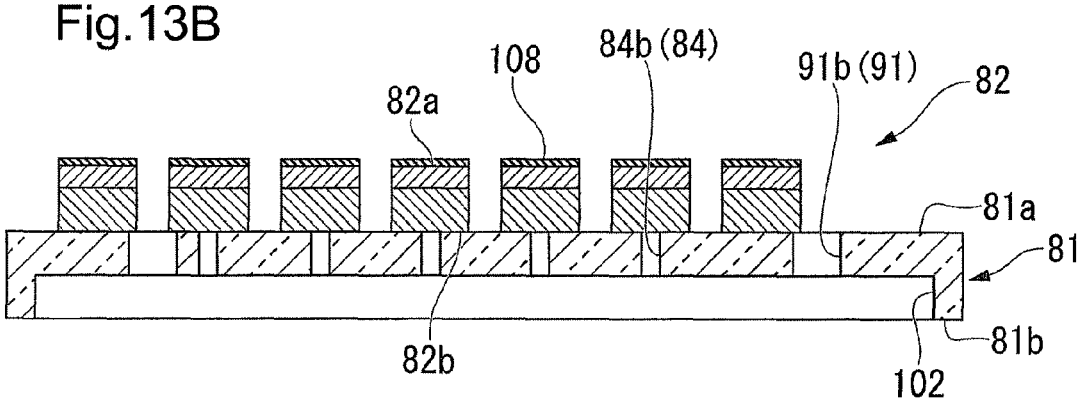

Then, as illustrated in FIGS. 13A and 13B, a mask 108 which covers the surface of each of the actuator plates 42, 82 (the central blocks 53 and the outer blocks 54) excepting the region for forming the drive electrodes 55 to 58 and the ground terminals 61 is formed (S23: mask forming step). Specifically, a mask material which is composed of, for example, a photosensitive dry film is adhered onto each of the first principal surfaces 42*a*, 82*a* of the actuator plates 42, 82. Then, the mask material is patterned using a photolithography technique to remove a part of the mask material corresponding to the region for forming each of the terminals 56, 58.

Figure 14A:
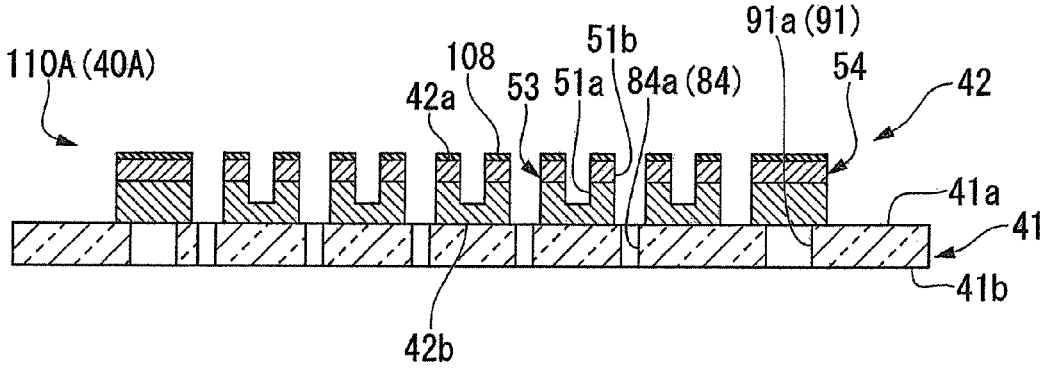
Figure 14B:
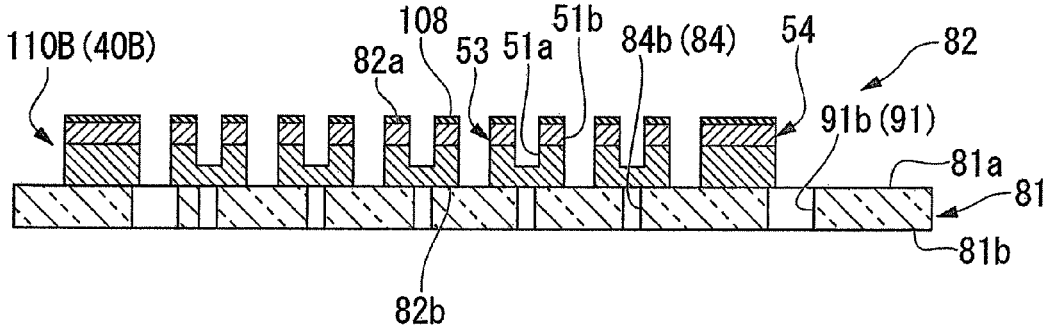

Then, as illustrated in FIGS. 14A and 14B, cutting such as dicing is performed on the first principal surfaces 42*a*, 82*a* of the central blocks 53 to form the ejection channels 51*a* (S24: ejection channel forming step). Although there has been described the method in which the ejection channel forming step (S24) is performed after the mask forming step (S23) in the present embodiment, the present invention is not limited thereto. The mask forming step (S23) may be performed after the ejection channel forming step (S24). However, performing the mask forming step (S23) prior to the ejection channel forming step (S24) is preferred, for example, because alignment marks used in the ejection channel forming step (S24) can be collectively formed on the mask 108.

Then, the entire second principal surfaces 41*b*, 81*b* of the base plates 41, 81 are ground using, for example, a grinder to remove the communication groove portions 102 (S25: base plate grinding step). Accordingly, the through holes 84*a*, 91*a* which penetrate the base plate 41 throughout the entire length in the X direction thereof and the through holes 84*b*, 91*b* which penetrate the base plate 81 throughout the entire length in the X direction thereof are formed. The base plate grinding step (S25) can be performed at any timing after the through hole forming step (S12). However, it is preferred to perform the base plate grinding step (S25) immediately before an adhering step (S31) (described below) in view of ensuring the strength of the base plates 41, 81.

(Third Step)

Figure 15:
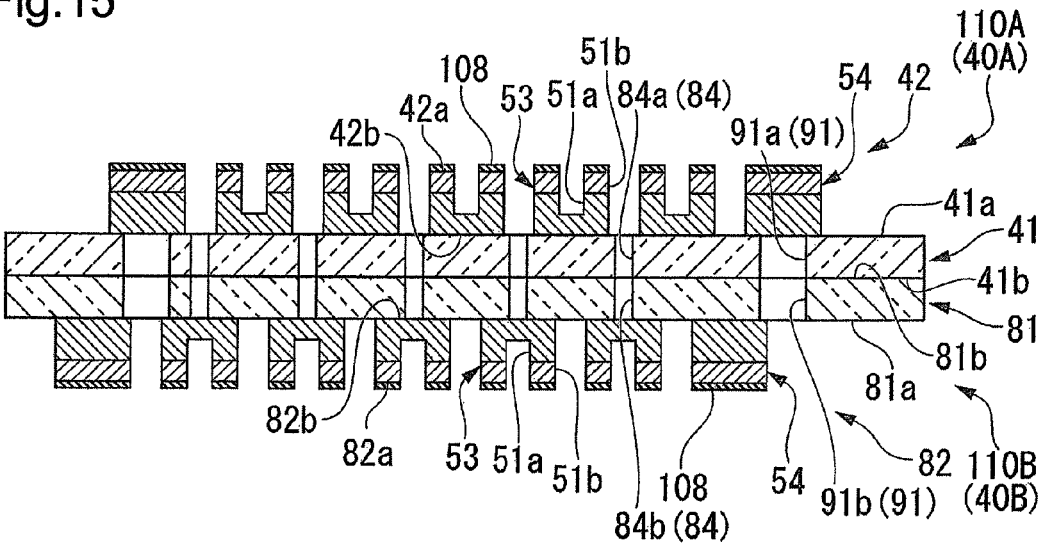
FIG. 15 is an explanatory diagram (cross-sectional view) for explaining the method of manufacturing the ink jet head.

As illustrated in FIG. 15, in the third step, a first bonded body 110A formed of the first base plate 41 and the first actuator plate 42 and a second bonded body 110B formed of the second base plate 81 and the second actuator plate 82 are first adhered together with the base plate 41 and the base plate 81 facing each other (S31: adhering step) Specifically, the base plate 41 and the base plate 81 are adhered together in a manner to allow the through holes 84*a* to communicate with the respective through holes 84*b* and allow the through holes 91*a* to communicate with the respective through holes 91*b* between the base plate 41 and the base plate 81. Accordingly, the first bonded body 110A and the second bonded body 110B are adhered together with the ejection channels 51*a* arranged in a staggered form between the bonded bodies 110A and 110B.

Then, the drive electrodes 55 to 58, the ground terminals 61, and the extraction electrodes 71, 72, 80, 90 are collectively formed on the bonded bodies 110A and 110B (S32: electrode forming step (plating step)). In the present embodiment, the electrode forming step (S32) is performed by electroless plating.

In the electrode forming step (S32), a catalyst is first applied to the electrode forming regions in which the drive electrodes 55 to 58, the ground terminals 61, and the extraction electrodes 71, 72, 80, 90 are to be formed in the bonded bodies 110A and 110B. Specifically, the bonded bodies 110A, 110B are first immersed in a stannous chloride solution to allow stannous chloride to be adsorbed onto the surfaces of the bonded bodies 110A, 110B, that is, sensitizing is performed.

Then, the bonded bodies 110A, 110B are lightly cleaned by, for example, water washing. Then, the bonded bodies 110A, 110B are immersed in a palladium chloride solution to allow palladium chloride to be adsorbed onto the surfaces of the bonded bodies 110A, 110B. Accordingly, an oxidation-reduction reaction occurs between the palladium chloride adsorbed onto the surfaces of the bonded bodies 110A, 110B and the stannous chloride adsorbed in the above sensitizing. As a result, metallic palladium is deposited as catalyst (activating).

In the present embodiment, the catalyst is also applied to the electrode forming regions in the base plates 41, 81 (the first principal surfaces 41*a*, 81*a* and the inner surfaces of the through holes 84, 91) in addition to the entire surfaces of the actuator plates 42, 82 in the bonded bodies 110A, 110B by an anchor effect. On the other hand, the regions other than the electrode forming regions (non-forming regions) in the base plates 41, 81 have a small surface roughness Ra. Thus, the catalyst is not applied to the non-forming regions.

Then, as illustrated in FIG. 16, the bonded bodies 110A, 110B with the catalyst (metallic palladium) applied thereto are immersed in a plating solution to allow the plating film 120 to be deposited on a part of the bonded bodies 110A, 110B to which the catalyst is applied. In the present embodiment, the non-forming regions include positions located between the central blocks 53 on the first principal surface 41*a* of the base plate 41 and the first principal surface 81*a* of the base plate 81. Thus, the catalyst is not applied to portions constituting the bottom surfaces of the dummy channels 51*b* of the base plates 41, 81. Therefore, when the individual electrodes 57 are formed by plating, it is possible to allow the plating film 120 to be deposited only on the side wall surfaces (the opposite surfaces of the central blocks 53), but not on the bottom surfaces in the inner surfaces of the dummy channels 51*b*. Accordingly, for example, it is not necessary to remove the plating film 120 deposited on the bottom surfaces of the dummy channels 51*b* by after processing, for example, laser. Thus, it is possible to reduce the manufacturing cost and to reduce dust generated in the after processing. In addition, it is possible to reliably prevent a short circuit of the individual electrodes 57 formed on the side wall surfaces of the dummy channels 51*b* through the bottom surfaces.

Figure 17:
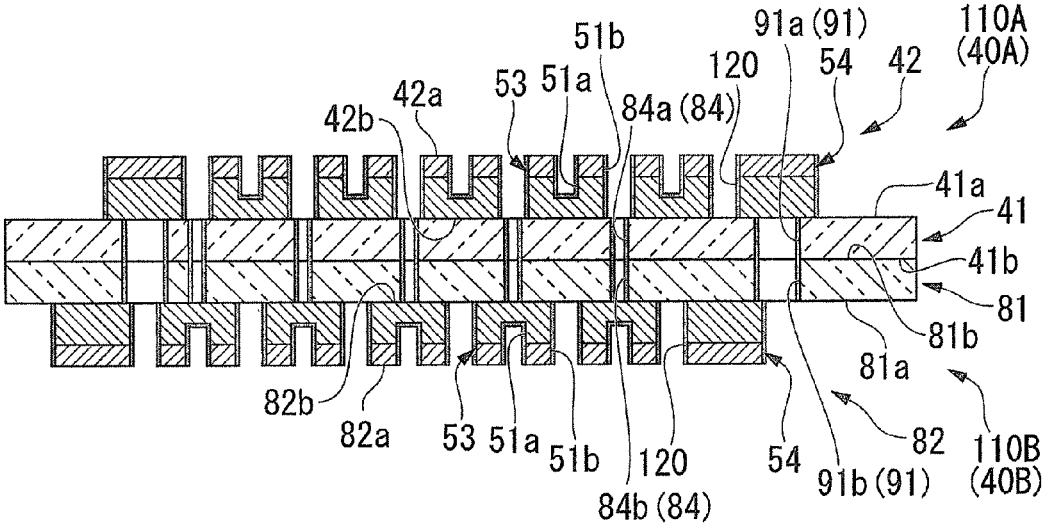
FIG. 17 is an explanatory diagram (cross-sectional view) for explaining the method of manufacturing the ink jet head.
Figure 20A:
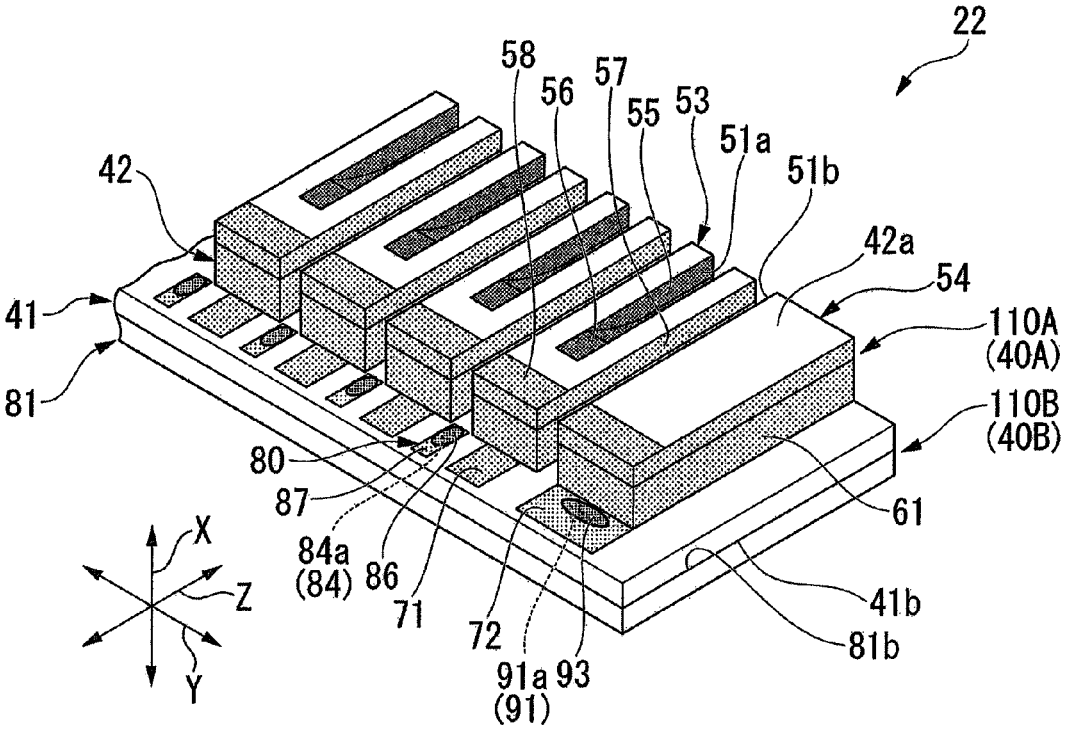
Figure 20B:
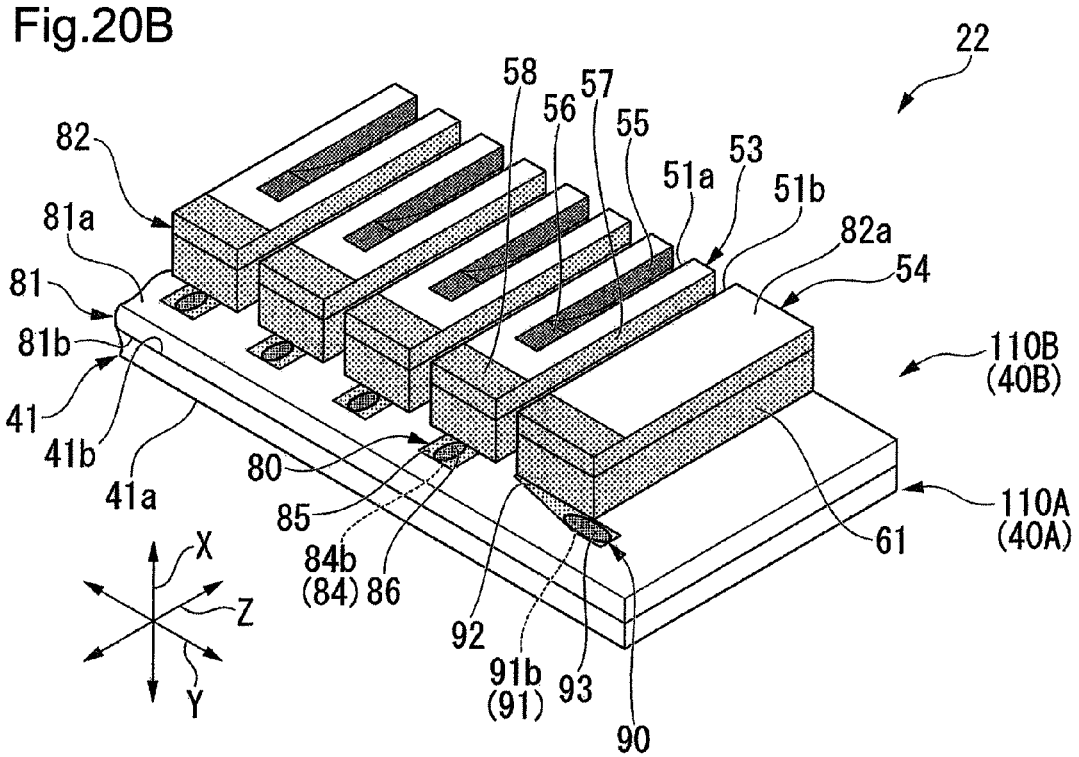

Then, as illustrated in FIG. 17, 20A, and 20B, the mask 108 formed on each of the first principal surfaces 42*a*, 82*a* of the actuator plates 42, 82 is removed (S33: lift-off step). Accordingly, the drive electrodes 55 to 58, the ground terminals 61, and the extraction electrodes 71, 72, 80, 90 are collectively formed on the bonded bodies 110A, 110B.

Then, as illustrated in FIGS. 4 and 5, the groove 62 is formed on each of the first principal surfaces 42*a*, 82*a* of the actuator plates 42, 82 (S34: groove forming step). Specifically, the groove 62 which extends along the Y direction so as to separate the common terminals 56 from the respective individual terminals 58 are formed on each of the first principal surfaces 42*a*, 82*a* of the actuator plates 42, 82 by cutting such as dicing. In the above embodiment, the case in which the groove 62 is formed on each of the actuator plates 42, 82 throughout the entire length in the Y direction thereof (the central blocks 53 and the outer blocks 54) has been described. However, it is only required that the groove 62 be formed at least on the central blocks 53.

Then, the cover plates 43 and 83 are respectively bonded to the first principal surface 42*a* of the actuator plate 42 and the first principal surface 82*a* of the actuator plate 82 (S35: cover plate bonding step). Specifically, the alignment between the actuator plate 42 and the cover plate 43 is performed in a manner to allow the ejection channels 51*a* of the actuator plate 42 to communicate with the respective slits 64 of the cover plate 43. Similarly, the alignment between the actuator plate 82 and the cover plate 83 is performed in a manner to allow the ejection channels 51*a* of the actuator plate 82 to communicate with the respective slits 64 of the cover plate 83. Further, in the present embodiment, the alignment between the plates 42 and 43 and the alignment between the plates 82 and 83 are performed in such a manner that, in the connection wiring line 65, the main wiring line 68 overlaps the groove 62 in the X direction, the common connection portions 66 are connected to the respective common terminals 56, and the ground connection portions 67 are connected to the respective ground terminals 61. After the alignment, the plates 43 and 83 are respectively bonded to the plates 42 and 82 with, for example, adhesive.

In the present embodiment, as described above, the outer shapes of the cover plates 43, 83 in plan view from the X direction respectively conform with the outer shapes of the actuator plates 42, 82 in plan view from the X direction. Thus, the above various alignment operations are automatically completed merely by aligning the end surfaces of the plates 42 and 43 with each other and aligning the end surfaces of the plates 82 and 83 to each other.

Then, the nozzle plate 44 is bonded to the front end surfaces of the head chips 40A and 40B (S36: nozzle plate bonding step).

Lastly, the flexible printed board 33 is connected onto the first principal surface 41*a* of the first base plate 41. Accordingly, the wiring pattern of the flexible printed board 33 is electrically connected to the first extraction electrodes 71, 72 and the land portions 87 of the second individual extraction electrodes 80 formed on the first principal surface 41*a* of the base plate 41.

The ink jet head 4 of the present embodiment is completed by mounting the ejecting portion 22 configured in this manner on the carriage 16.

As described above, in the present embodiment, the inner surfaces of the through holes 84*a*, 84*b*, 91*a*, 91*b* are roughened in the through hole forming step (S12). Further, the second extraction electrodes 80, 90 are routed to the first principal surface 41*a* of the base plate 41 through the through holes 84*a*, 84*b*, 91*a*, 91*b* in the electrode forming step (S32).

According to this configuration, it is possible to ensure electrical continuity between each of the head chips 40A, 40B and the flexible printed board 33 merely by connecting the flexible printed board 33 onto the first principal surface 41*a* of the first base plate 41. Thus, it is possible to achieve high-density recording while reducing the number of components and simplifying the configuration compared to a conventional configuration in which separate flexible printed boards 33 are connected to the respective head chips 40A and 40B.

In particular, in the present embodiment, roughening the inner surfaces of the through holes 84*a*, 84*b*, 91*a*, 91*b* in the through hole forming step (S12) enables the inner surfaces of the through holes 84*a*, 84*b*, 91*a*, 91*b* to have an anchor effect. Accordingly, the plating film 120 can be collectively formed on the drive electrodes 55 to 58, 61, and the inner surfaces of the through holes 84*a*, 84*b*, 91*a*, 91*b* in the electrode forming step (S32). Thus, it is possible to improve the efficiency of the manufacturing process steps and also to simplify the manufacturing process steps.

In the present embodiment, the through hole forming step (S12) is performed using sandblast. Thus, it is possible to roughen the inner surfaces of the through holes 84*a*, 84*b*, 91*a*, 91*b* simultaneously with the formation of the through holes 84*a*, 84*b*, 91*a*, 91*b*. As a result, it is possible to further improve the efficiency of the manufacturing process steps.

Each of the base plates 41, 81 is made of a glass material. Thus, it is possible to reduce the surface roughness Ra in the non-forming region. In this case, it is possible to prevent the plating film 120 from being formed in the non-forming region. Thus, a patterning step after the formation of the plating film 120 is not required. As a result, it is possible to improve the efficiency of the manufacturing process steps and also to reduce the cost.

The printer 1 of the present embodiment is provided with the ink jet head 4. Thus, it is possible to provide the printer 1 capable of coping with high-density recording and having excellent reliability.

The technical scope of the present invention is not limited to the above embodiment. Various modifications may be made without departing from the gist of the invention.

For example, in the above embodiment, the ink jet printer 1 has been described as an example of the liquid jet apparatus. However, the liquid jet apparatus is not limited to printers. The liquid jet apparatus may be, for example, a fax machine or an on-demand printing machine.

Further, although the printer 1 for multiple colors that is loaded with a plurality of ink jet heads 4 has been described in the above embodiment, the present invention is not limited thereto. For example, the printer 1 may be a printer for a signal color that is loaded with a single ink jet head 4.

Various materials such as a water-based ink, an oil-based ink, a UV ink, a metal fine particle ink, and a carbon ink (carbon black, carbon nanotube, fullerene, and graphene) may be used as the ink used in the embodiment of the present invention. Among the above inks, a water-based ink, an oil-based ink, and a UV ink are preferably used in the printer 1 for multiple colors. On the other hand, a metal fine particle ink and a carbon ink are preferably used in the printer 1 for a single color.

Although each of the base plates 41, 81 is made of glass in the above embodiment, the present invention is not limited thereto. The material of each of the base plates 41, 81 may be appropriately modified as long as it is capable of reducing the surface roughness Ra in the non-forming region to a value that does not enable the formation of the plating film 120 (approximately 100 Å, for example). For example, a ceramic material may be used.

Although the base plate 41 with the actuator plate 42 bonded thereto and the base plate 81 with the actuator plate 82 bonded thereto are bonded together to construct the two-array type ejecting portion 22 in the above embodiment, the present invention is not limited thereto. For example, an ejecting portion that includes a single base plate and actuator plates disposed on opposite sides in the thickness direction of the base plate may be employed.

Figure 21:
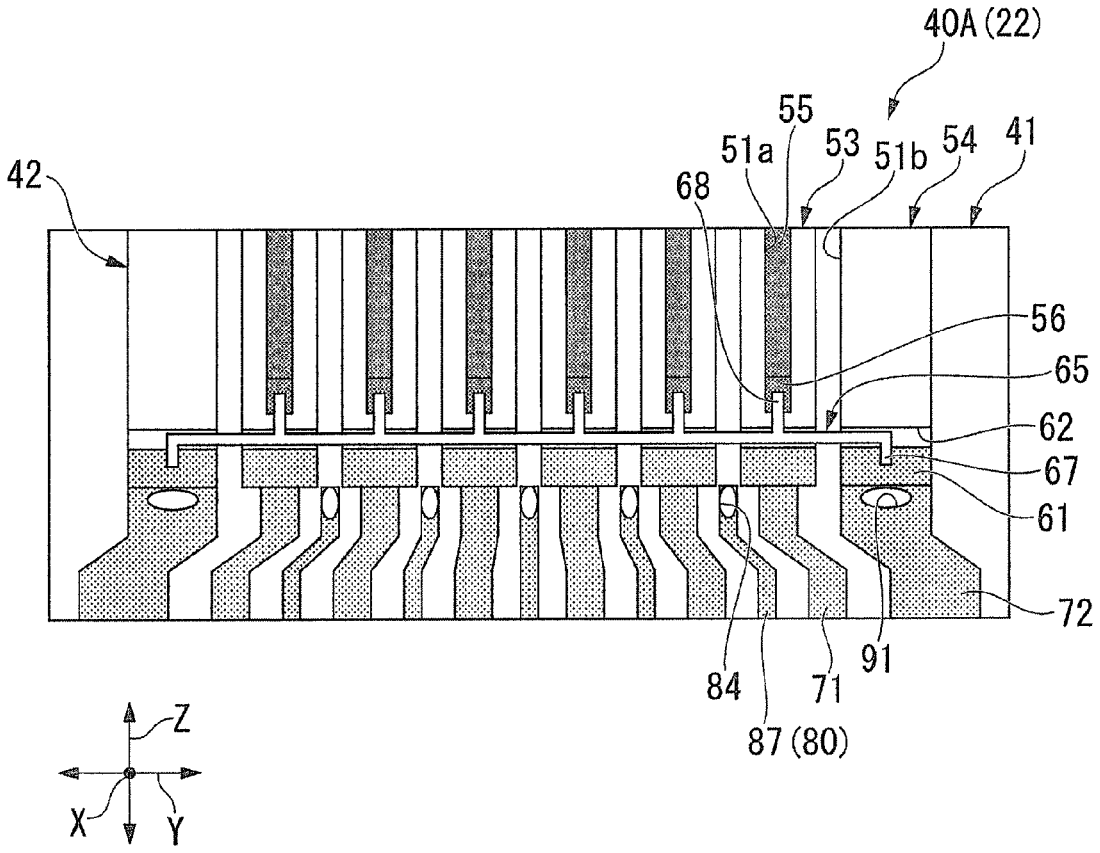
FIG. 21 is a plan view illustrating another configuration of the ejecting portion viewed from the first head chip.

Although the first extraction electrodes 71, 72 and the land portions 87 of the second extraction electrodes 80 are linearly formed along the Z direction in the above embodiment, the present invention is not limited thereto. For example, as illustrated in FIG. 21, the first extraction electrodes 71, 72 and the land portions 87 of the second extraction electrodes 80 may be formed to extend outward in the Y direction toward the rear side. In this case, a specific shape of the first extraction electrodes 71, 72 and the land portions 87 of the second extraction electrodes 80 may be a sectoral shape or may also be a trapezoidal shape. That is, any widening shape whose width in the Y direction increases toward the rear side in the Z direction may be employed.

In this configuration, the distance between each of the first extraction electrodes 71, 72 and each of the land portions 87 of the second extraction electrodes 80 increases rearward. Thus, it is possible to prevent a short circuit between each of the first extraction electrodes 71, 72 and each of the land portions 87 of the second extraction electrodes 80 to thereby ensure the electrical reliability. In addition, it is possible to prevent the electrode pattern from becoming complicated.

Further, it is also possible to increase the width of each of the first extraction electrodes 71, 72 and each of the land portions 87 of the second extraction electrodes 80 by allowing the first extraction electrodes 71, 72 and the land portions 87 of the second extraction electrodes 80 to extend outward in the Y direction toward the rear side.

Although each of the individual through holes 84 is formed between adjacent first extraction electrodes 71 in the above embodiment, the present invention is not limited thereto. The first extraction electrodes 71 and the individual through holes 84 may be arranged to be displaced in the Z direction.

It is only required that the individual through holes 84*a* at least partially communicate with the respective individual through holes 84*b* and the ground through holes 91*a* at least partially communicate with the respective ground through holes 91*b* between the base plates 41 and 81. That is, in the present embodiment, the plating film 120 can be formed by roughening the second principal surfaces 41*b*, 81*b* by grinding in the through hole forming step (S12). Thus, when the individual through holes 84*a* at least partially communicate with the respective individual through holes 84*b* and the ground through holes 91*a* at least partially communicate with the respective ground through holes 91*b*, the through portions 86, 93 are formed through the plating film 120 formed on the second principal surfaces 41*b*, 81*b* of the base plates 41, 81.

Although the roughening of the inner surfaces of the through holes 84*a*, 84*b*, 91*a*, 91*b* is simultaneously performed with the formation of the through holes 84*a*, 84*b*, 91*a*, 91*b* using sandblast in the through hole forming step (S12) in the above embodiment, the present invention is not limited thereto. That is, the formation of the through holes 84*a*, 84*b*, 91*a*, 91*b* (boring step) and the roughening of the inner surfaces of the through holes 84*a*, 84*b*, 91*a*, 91*b* (roughening step) may be separately performed.

In addition to the above, the components in the above embodiment can be appropriately replaced with well-known components, or the above modified examples may be appropriately combined without departing from the gist of the invention.

What is claimed is:

1. A method of manufacturing a liquid jet head comprising:

a through hole forming step of forming through holes on a base plate;

an actuator portion disposing step of separately disposing a first actuator portion and a second actuator portion, the first actuator portion and the second actuator portion being configured to jet liquid, on opposite sides in a thickness direction of the base plate at positions avoiding the through holes; and a plating step of performing plating on the base plate, the first actuator portion, and the second actuator portion to form first electrodes configured to drive the first actuator portion and second electrodes configured to drive the second actuator portion, wherein the through hole forming step includes a boring step of forming the through holes on the base plate, and a processing step of roughening inner surfaces of the through holes formed in the boring step, and the second electrodes are routed to a principal surface of the base plate through the through holes, the principal surface facing the first actuator portion, in the plating step.

2. The method of manufacturing the liquid jet head according to claim 1, wherein the boring step and the processing step are collectively performed in the through hole forming step.

3. The method of manufacturing the liquid jet head according to claim 2, wherein sandblast is used in the boring step.

4. The method of manufacturing the liquid jet head according to claim 1, wherein the a material of the base plate is a glass material.

* * * * *